US009055822B2

(12) United States Patent
Baldassarra

(10) Patent No.: US 9,055,822 B2
(45) Date of Patent: Jun. 16, 2015

(54) STRUCTURAL FRAMEWORK FOR CONVERTIBLE ARMCHAIR OR SOFA

(75) Inventor: Dionisio Baldassarra, Altamura (IT)

(73) Assignee: COMODO ITALIA S.R.L. (IT)

( * ) Notice: Subject to any disclaimer, the term of this patent is extended or adjusted under 35 U.S.C. 154(b) by 153 days.

(21) Appl. No.: 13/148,976

(22) PCT Filed: Jan. 29, 2010

(86) PCT No.: PCT/EP2010/000528

§ 371 (c)(1),
(2), (4) Date: Aug. 11, 2011

(87) PCT Pub. No.: WO2010/091792

PCT Pub. Date: Aug. 19, 2010

(65) Prior Publication Data

US 2011/0314600 A1 Dec. 29, 2011

(30) Foreign Application Priority Data

Feb. 13, 2009 (IT) ..... MI2009A0189

(51) Int. Cl.
*A47C 17/02* (2006.01)
*A47C 17/22* (2006.01)
*A47C 17/04* (2006.01)

(52) U.S. Cl.
CPC ..... *A47C 17/22* (2013.01); *A47C 17/04* (2013.01)

(58) Field of Classification Search
CPC .... A47C 17/225; A47C 1/0355; A47C 17/04; A47C 17/213; A47C 19/14
USPC ..... 5/13, 17, 28–36, 43–46.1
See application file for complete search history.

(56) References Cited

U.S. PATENT DOCUMENTS 1,139,785 A * 5/1915 Luppino ..... 5/48
1,384,932 A * 7/1921 Whistance-Smith ..... 5/46.1

(Continued)

FOREIGN PATENT DOCUMENTS

| | | |
|---|---|---|
| EP | 1190649 A1 | 3/2002 |
| EP | 1310195 A1 | 5/2003 |
| WO | 0349579 A1 | 6/2003 |

OTHER PUBLICATIONS

International Search Report PCT/EP2010/000528; Dated May 27, 2010.

*Primary Examiner* — Michael Trettel
*Assistant Examiner* — Myles Throop
(74) *Attorney, Agent, or Firm* — Cantor Colburn LLP

(57) ABSTRACT

A structural framework for a convertible armchair or sofa comprising a box-shaped base supporting a plurality of frames hinged to one another, including a particular frame suitable, alone, for directly or indirectly supporting a seat cushion on one of its sides and, in combination with the other frames, for supporting a mattress on its other side, and mechanisms for the displacement of said frames and of a backrest and supporting foot, in relation to one another and with respect to the base, between: a stable configuration as a sofa or armchair, wherein the frames remain inside said base, where they identify a cavity for containing the folded mattress; and a stable configuration as a bed wherein the frames extend forwards, becoming aligned to define a horizontal resting surface that extends beyond the base and is supported by the foot, while the backrest moves underneath the resting surface, and a stable configuration as a recliner, wherein, by comparison with the configuration as an armchair or sofa, the backrest is tilted further backwards and the particular frame extends further forwards and/or is tilted upwards.

10 Claims, 24 Drawing Sheets

(56) References Cited

U.S. PATENT DOCUMENTS

| | | | | | |
|---|---|---|---|---|---|
| 4,097,938 | A * | 7/1978 | Pringle | 5/18.1 |
| 4,307,912 | A * | 12/1981 | Watt et al. | 297/85 R |
| 4,625,345 | A * | 12/1986 | Wood | 5/13 |
| 4,669,135 | A * | 6/1987 | Gonzalez | 5/37.1 |
| 4,691,961 | A * | 9/1987 | Rogers et al. | 297/61 |
| 5,044,692 | A * | 9/1991 | Tidwell et al. | 297/391 |
| 5,064,244 | A * | 11/1991 | Sproule | 297/68 |
| 5,138,727 | A * | 8/1992 | Hanes et al. | 5/13 |
| 5,695,239 | A * | 12/1997 | Johnson et al. | 297/69 |
| 5,740,564 | A * | 4/1998 | Hankins et al. | 5/12.1 |
| 5,815,857 | A * | 10/1998 | De Lorenzo | 5/13 |
| 7,618,091 | B2 * | 11/2009 | Akaike et al. | 297/216.12 |
| 8,438,676 | B2 * | 5/2013 | Murphy | 5/35 |
| 8,806,672 | B1 * | 8/2014 | Raymond et al. | 5/12.1 |
| 2003/0088915 | A1 * | 5/2003 | De Lorenzo | 5/13 |
| 2003/0088916 | A1 | 5/2003 | De Lorenzo | |
| 2006/0103218 | A1 * | 5/2006 | De Vroe | 297/423.26 |
| 2013/0097774 | A1 * | 4/2013 | Garland | 5/29 |

* cited by examiner

STRUCTURAL FRAMEWORK FOR CONVERTIBLE ARMCHAIR OR SOFA

The present invention refers to a convertible armchair or sofa.

There are numerous mechanical solutions that enable an armchair or sofa to be converted into a bed.

The purpose of said mechanisms consists in making the procedure for converting the sofa into a bed and vice versa as straightforward and safe as possible.

With reference to patents MI2001A 002613, MI2002A 000588 and MI2005A 000146 held by the present applicant, users can convert a sofa or armchair into a bed in a straightforward and intuitive manner, simply by pulling the backrest of the armchair or sofa towards them and thereby enabling the mechanism to extend the frames that become aligned and comprise the bed frame complete with a mattress. There is no need to remove the cushions that form the seat and backrest of the sofa, because they are automatically repositioned one against the other underneath the bed.

With the same simple action, users can lift the end of the bed to enable the mechanism to fold said frames and mattress back inside the sofa or armchair, while the cushions for the seat and backrest return to their original position.

In addition to the mechanical solutions that enable the conversion of a sofa or armchair into a bed, there are also numerous so-called recliner armchairs on the market.

Recliners enable a conversion from a seated position to a more relaxed, reclining position. These armchairs are often complete with headrests and supporting means suitable for resting the feet. In this sector too, numerous different mechanisms have been used to implement the same movement, involving a variety of kinematic solutions, but all serving the same purpose.

The two solutions are not suitable, however, as substitutes for one another, in the sense that it is not possible to sleep on a recliner armchair in the same way as on a proper bed fitted with a mattress and, vice versa, it is not possible to occupy a reclining position on a bed, e.g. in order to read a book or watch the television.

The technical aim of the present invention is therefore to produce a convertible armchair or sofa that enables the technical drawbacks of the known state of the art to be overcome.

Within the context of this technical aim, one object of the invention is to produce an armchair or sofa that can be converted in an extremely straightforward and intuitive manner so as to offer the user a plurality of different, very comfortable resting positions.

Another object of the invention is to produce an armchair or sofa that is convertible without the need to remove the seat and/or backrest cushions, or the mattress for when it is configured as a bed.

Another object of the invention is to produce an armchair or sofa that can be converted without having to first move it away from the rear wall.

Another object of the invention is to produce an armchair or sofa that can be fitted with a headrest and a footrest so as to make it particularly comfortable in a reclining position.

Another, not necessarily last, object of the invention is to produce a convertible armchair or sofa that comprises extremely precise, safe and reliable mechanisms for changing its configuration.

The technical aim and these and other objects according to the present invention are achieved by a convertible armchair or sofa according to claim 1.

The structural framework of the armchair or sofa according to the invention enables its configuration as a sofa or armchair to be switched to that of a bed, or of a recliner with interdependent mechanisms that globally lend the structural framework essentially only one degree of freedom. The conversion to one or other configuration depends only on the action taken by the user.

The structural framework of the sofa or armchair is designed to be converted simply and safely into a comfortable bed.

The user simply has to pull on the backrest of the armchair to enable the frames enclosed therein to unfold and form a bed complete with a mattress. The cushions that comprise the backrest and seat are automatically positioned one against the other underneath the bed. In an equally straightforward manner, lifting the end of the bed enables the mechanism to fold the frames back inside the armchair and restore the backrest and seat cushions to their original position. At this point, users can comfortably sit in the armchair and, if they wish, while remaining seated, they can press their backs against the backrest of the armchair to enable the mechanism to switch to the reclining configuration. This configuration consists in a greater tilting angle of the backrest and a consequent displacement and greater tilting angle of the seat. The mechanism may preferably also enable the raising of a headrest and of a footrest, so as to make the reclining position even more comfortable.

During the opening of the bed, the mechanisms that are used to raise the headrest and the footrest ensure that the latter are positioned so as not to bother the user or interfere with the other components of the armchair.

Further characteristics and advantages of the invention will emerge more clearly from the following description of a preferred, but not exclusive embodiment of the structural framework of the convertible armchair or sofa according to the invention, illustrated as a non-limiting example in the attached drawings, wherein.

Figure 16:
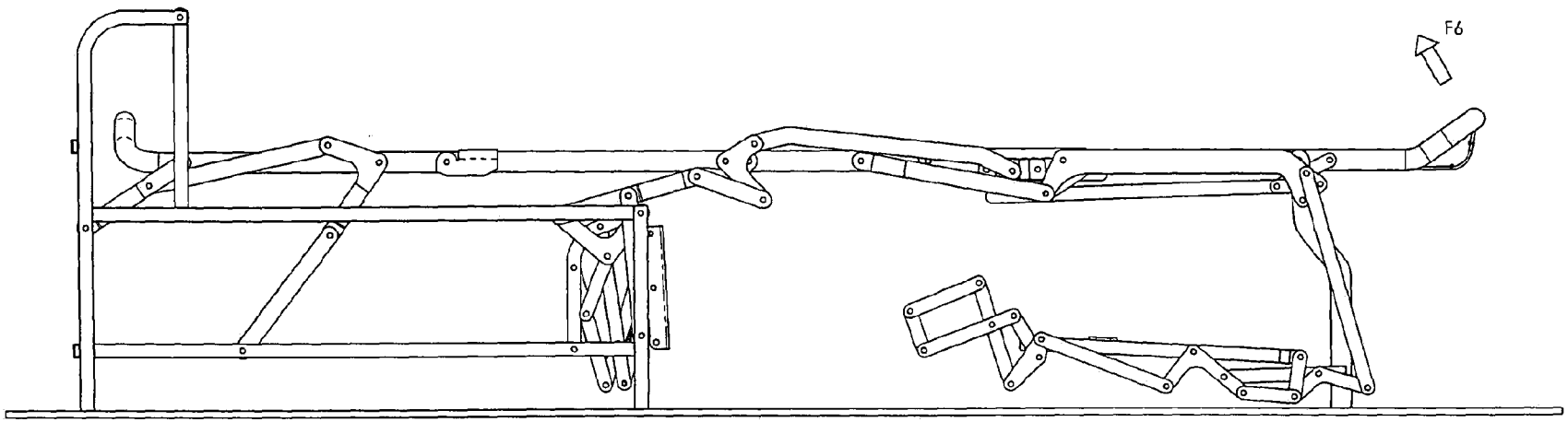
Figure 17:
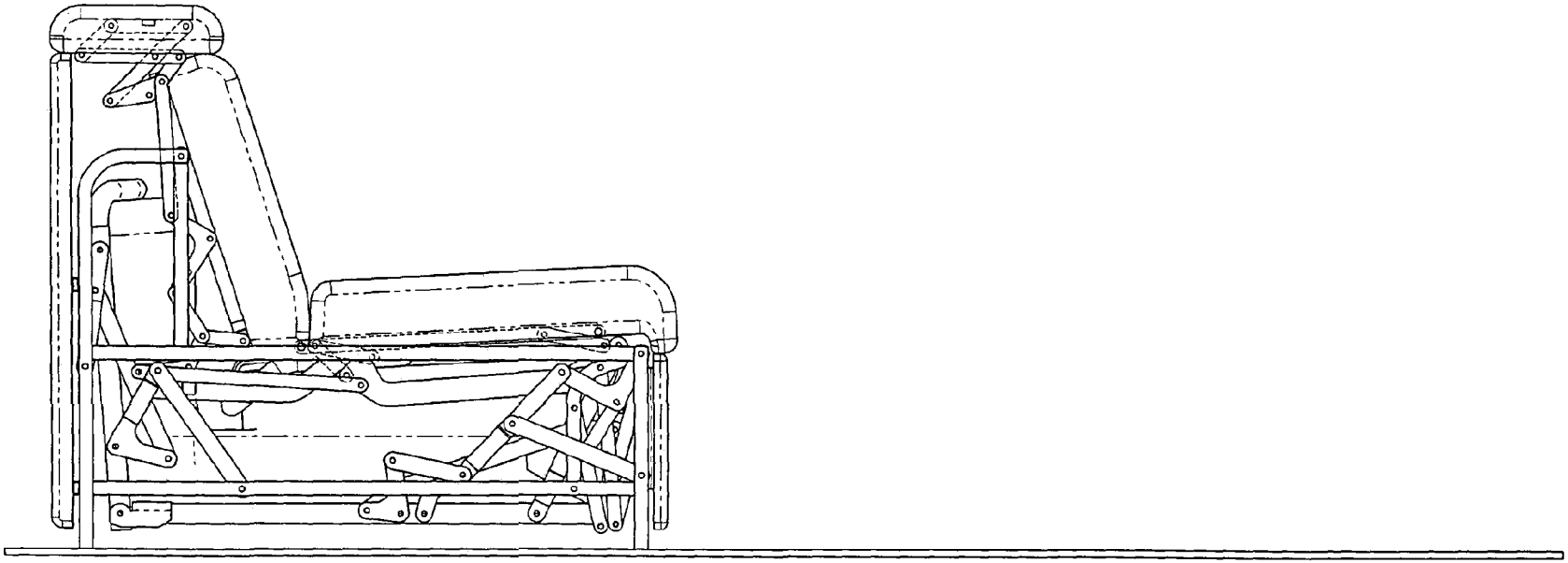
Figure 18:
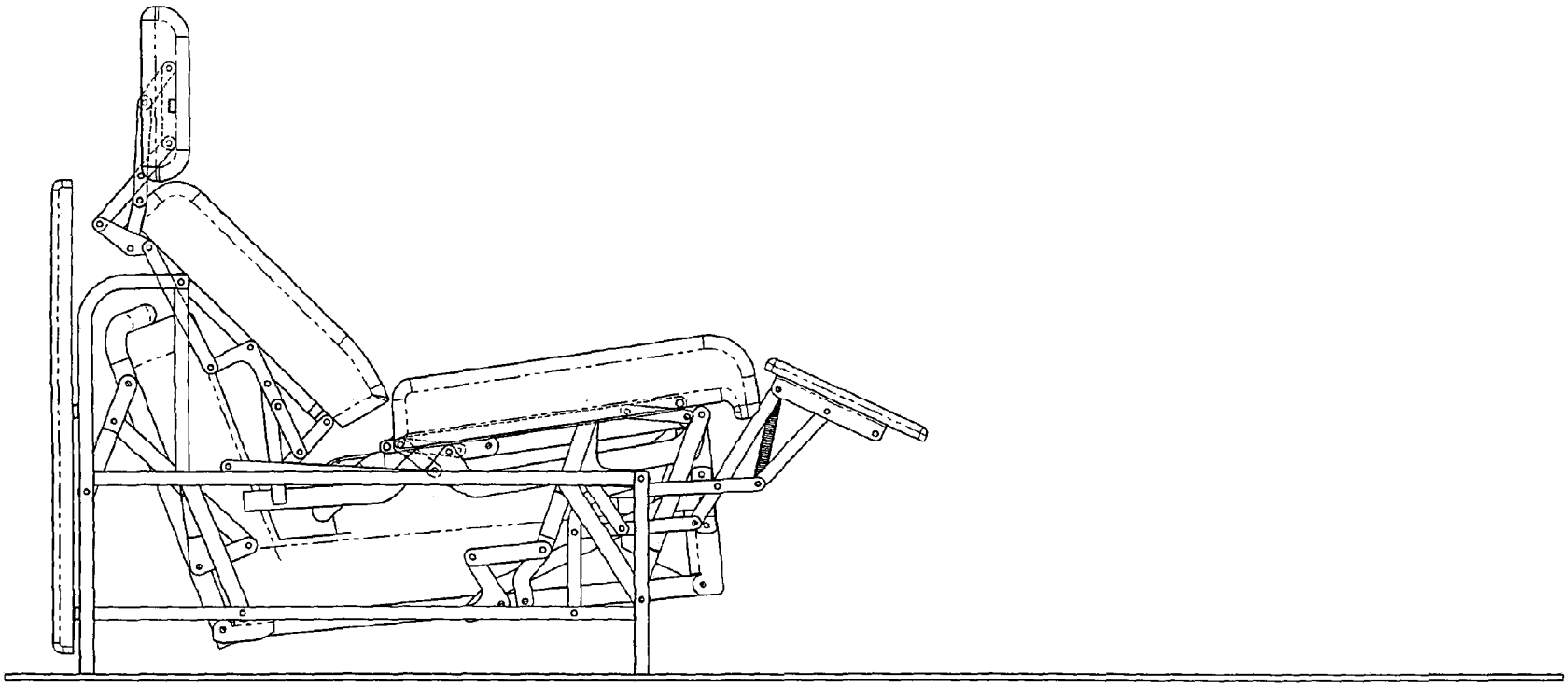
Figure 19:
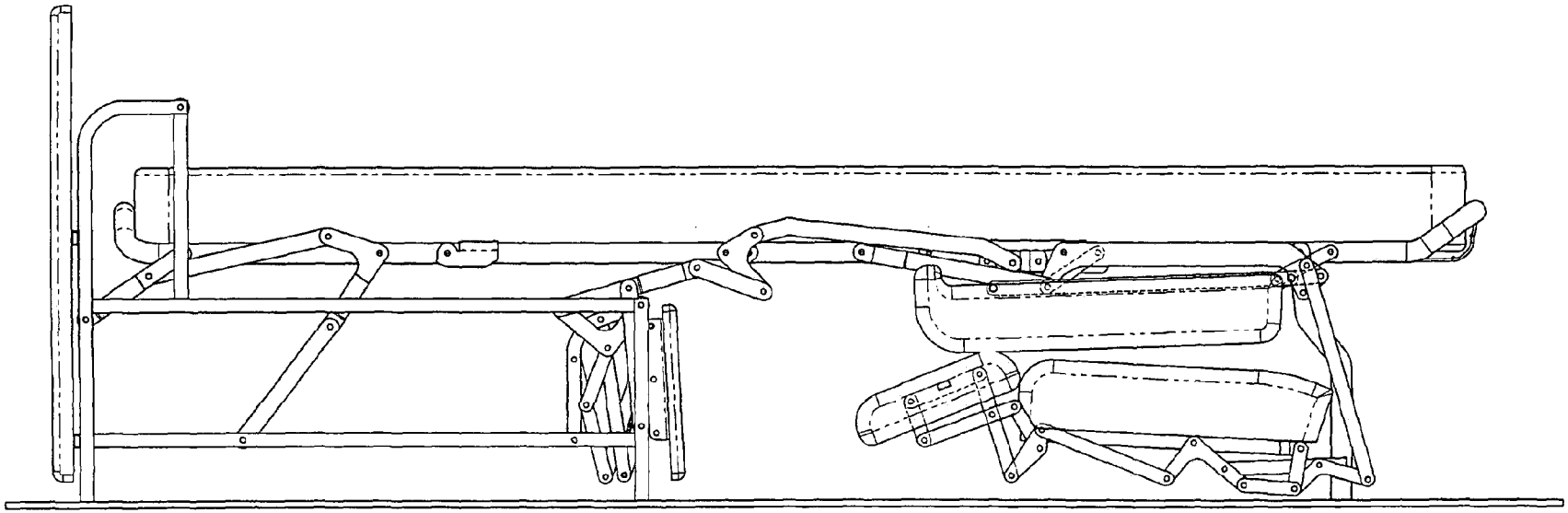
Figure 24:
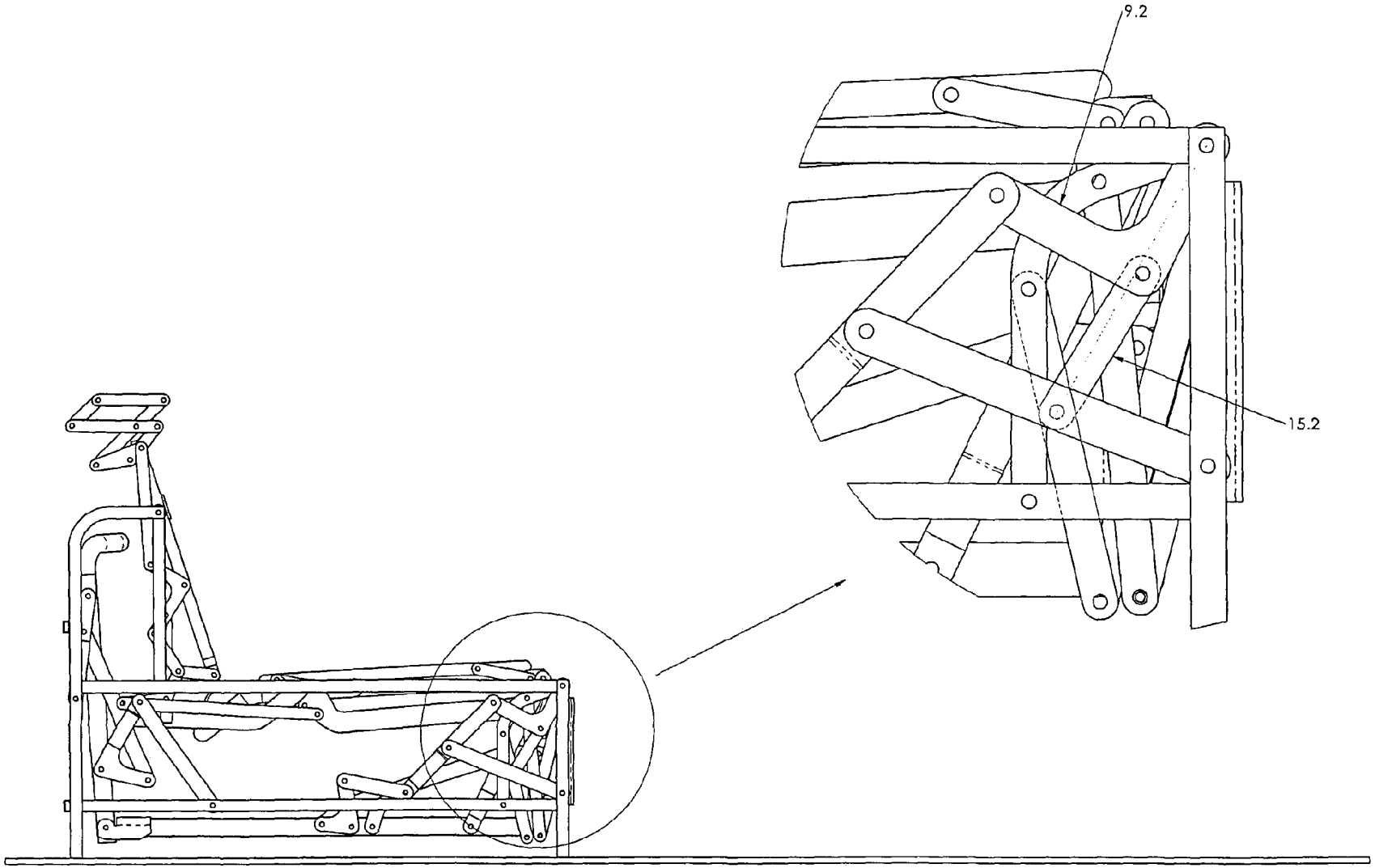

FIGS. from 10 to 15 show various intermediate positions of the structural framework according to the invention between the configurations as an armchair and as a bed;

FIG. 16 shows a side view of the structural framework according to the invention configured as a bed;

FIG. 17 shows a side view of the structural framework according to the invention configured as an armchair complete with cushions and a mattress;

FIG. 18 shows a side view of the structural framework according to the invention configured as a recliner complete with cushions and a mattress;

FIG. 19 shows a side view of the structural framework according to the invention configured as a bed complete with cushions and a mattress;

FIGS. from 20 to 23 show portions of the structural framework according to the invention in detail;

FIG. 24 shows a detail of the side view of the structural framework according to the invention configured as an armchair.

With particular reference to the above-described figures, the structural framework for a convertible armchair or sofa, generically indicated by the numeral 1, comprises a base 2, that supports a plurality of frames 3, 4, 5 and 6, that are hinged together, a foot 7 designed to support the end of the bed, and a backrest 8. The structural framework 1 comprises a plurality of mechanisms 9,10,11,12 and 13 for moving the frames 3, 4, 5, 6, the foot 7 and the backrest 8 in relation to one another and to the base 2.

All of the mechanisms described hereinafter extend on one side of the armchair, on the understanding that there is a mirror-image copy of them on the opposite side. The kinematic concept can consequently be described as two-dimensional (side view), but in its practical implementation we have to add the third dimension, so there has to be a mirror-image copy of the mechanism on the opposite side.

We consequently have a base mechanism 9, that moves the second frame 4, a supporting mechanism 10 that moves the first frame 3, a tipping mechanism 11 that moves the third and fourth frames 5 and 6 in relation to the second frame 4 and opens the foot 7, a mechanism 12 that synchronises the movement of the mechanisms 9 and 11, and a mechanism 13 for tipping the backrest in relation to the foot.

The structural framework 1 also comprises a headrest mechanism 14 and a footrest mechanism 15. These latter two mechanisms can also be considered optional, in that the armchair can also function without these two accessories, although they are important for a comfortable reclining position.

The structural framework 1 is completed with a seat supporting mechanism 16 designed to anchor the cushion to the seat. This mechanism is also optional, but it enables the armchair to be converted into a bed without having to remove the cushion from the seat.

In some figures, the structural framework 1 is shown with schematically illustrated cushions panels and mattress so as to facilitate the reader's understanding of how the mechanics are applied. We consequently have a rear panel 17, a mattress for the bed 18, a cushion for the armchair's seat 19, a cushion for its backrest 20, a cushion for its headrest 21 and a cushion for its footrest 22.

Figure 20:
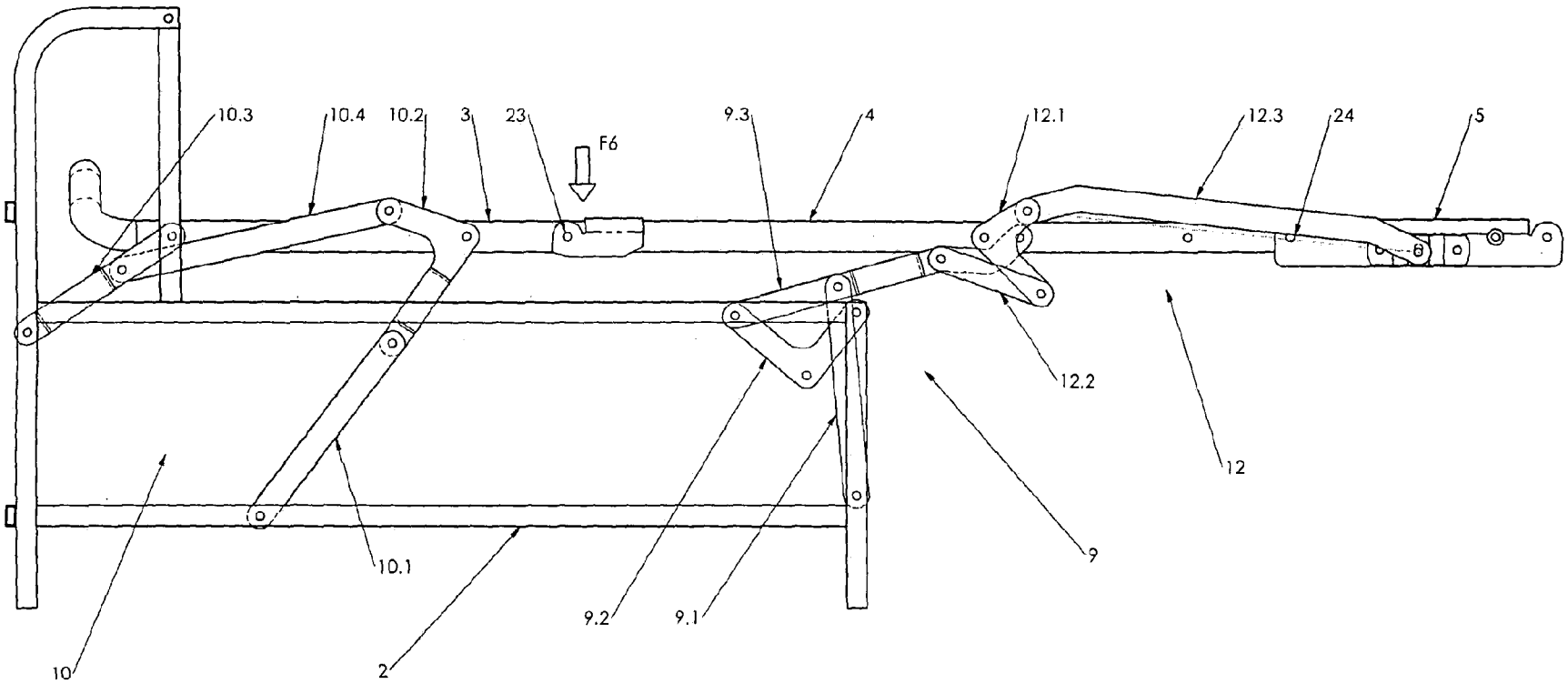

In particular, with reference to FIG. 20, the base mechanism 9 consists of three levers: a first and a second lever 9.1 and 9.2 hinged at one end to a vertical member of the base 2, while the other end is hinged to a third lever 9.3. This third lever 9.3 is in turn hinged at an intermediate point along the second frame 4. This square forms the heart of the mechanism in that, by rotating in one direction, it enables the displacement from the armchair or sofa configuration to the recliner configuration, while rotating in the opposite direction enables the armchair or sofa configuration to be converted into the bed configuration.

The supporting mechanism 10 is composed of a fourth lever 10.1 hinged at one end to a horizontal member of the base and at the other end to a fifth lever 10.2 folded in an L-shape and hinged at an intermediate point to the first frame 3. A sixth lever 10.3 is hinged at one end to the base 2, while the other end is hinged to the first frame 3. A seventh lever 10.4 connects an intermediate point on the sixth lever 10.3 to the other end of the fifth lever 10.2. The purpose of this so-called supporting mechanism is to support the first frame 3 when the framework is configured as a bed. The whole supporting mechanism 10 can be replaced by a single hinged connection between the free end of the first frame 3 and the base 2, but this reduces the stability of the bed in the event of loading in line with the hinge 23 between the first frame 3 and the second frame 4.

Figure 7:
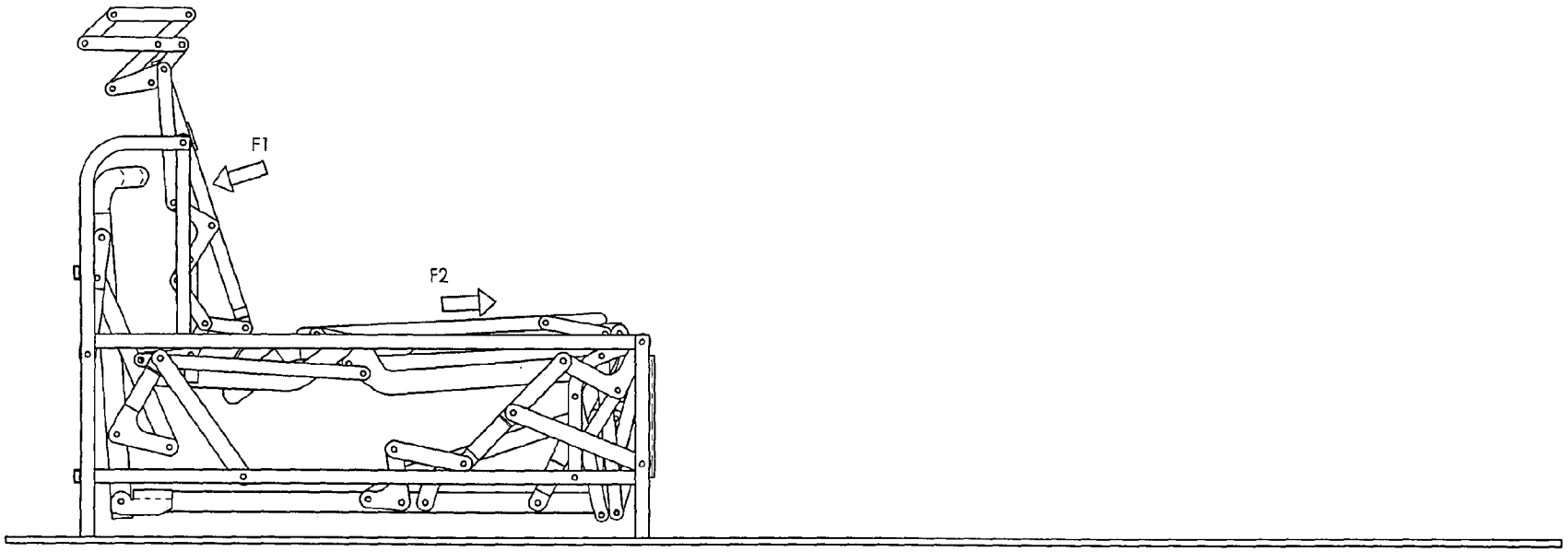
FIG. 7 shows a side view of the structural framework according to the invention configured as an armchair.
Figure 8:
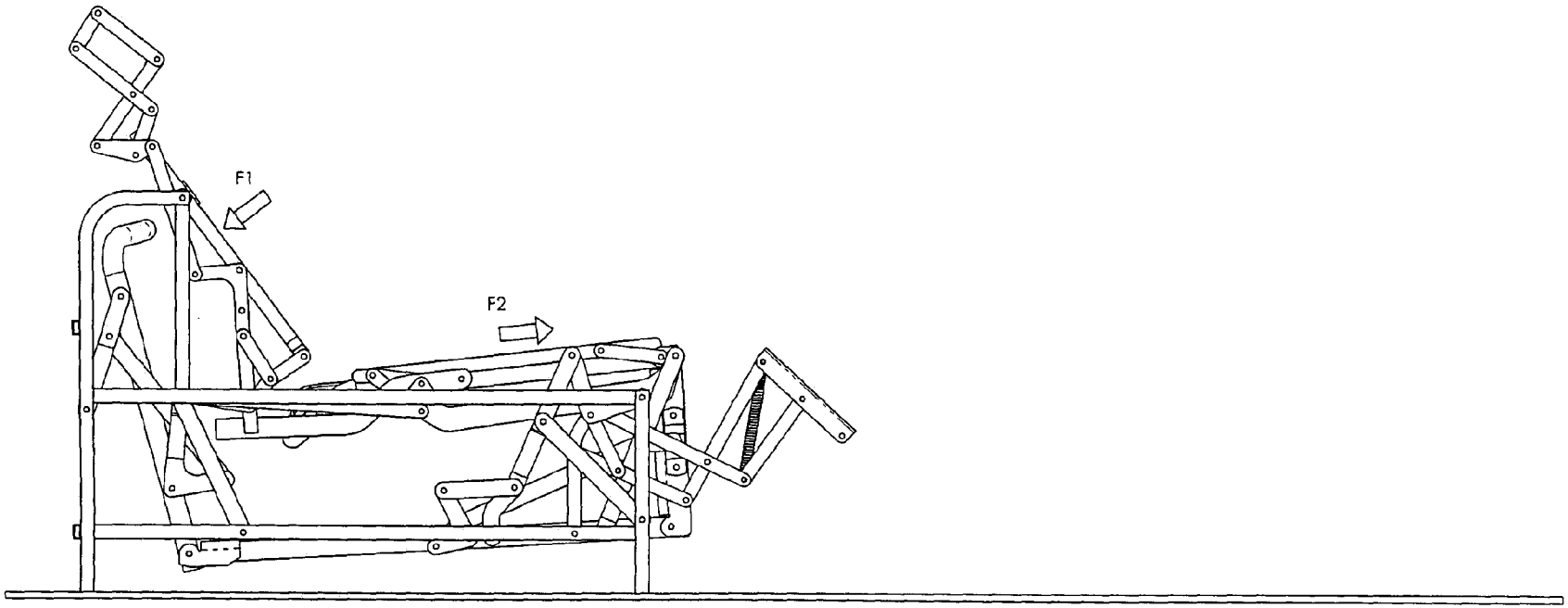
FIG. 8 shows a side view of the structural framework according to the invention in an intermediate configuration, between the armchair and the recliner.

Again in FIG. 20, if we analyse the synchronising mechanism 12, this comprises an eighth lever 12.1 folded in an L-shape and hinged at an intermediate point to the second frame 4, and at one end to a ninth lever 12.2, the opposite end of which is connected to an intermediate point on the third lever 9.3. These last two levers form a sort of movement down-scaling device, that enables the conversion of a rotation well beyond 180.degree. of the third lever 9.3 in relation to the second frame 4 into a rotation of less than 180.degree. of the eighth lever 12.1. In fact, a rotation greater than 180. degree. cannot be used to synchronise the movement with the subsequent mechanisms. The tenth lever 12.3 consequently has one end hinged to the eighth lever 12.1, while the other engages in a slot 5*a* on the third frame 5. The mechanism described so far has practically the only one degree of freedom when configured as a bed because the slot 5*a* comes to lie in a direction virtually perpendicular to the direction of the hinged connections of the tenth lever 12.3. It should be noted that the hinge 23 between the frames 3 and 4, and the hinge 24 between the frames 4 and 5, have physical limit stops when they reach 180. degree., as shown in FIG. 20, and this position consequently represents a limit position for their movement. It is easy to understand the function of the slot 5*a* in FIGS. 7, 8 and 9. In these configurations, the third frame 5 is positioned at an approximately 90. degree. angle in relation to the second frame 4 and it is held stably in position by the tipping mechanism 11. In the conversion from the armchair or sofa configuration to the recliner configuration, the third lever 9.3 rotates in relation to the second frame 4 and induces the rotation the eighth lever 12.1, but through a much narrower angle. This eighth lever transfers the movement to the tenth lever 12.3. The slot 5*a* allows for this movement because it now comes to lie in the direction of the hinged connections of the tenth lever 12.3. We can therefore say that the slot 5*a* enables the displacement towards the reclining configuration, which would otherwise be prevented.

Figure 21:
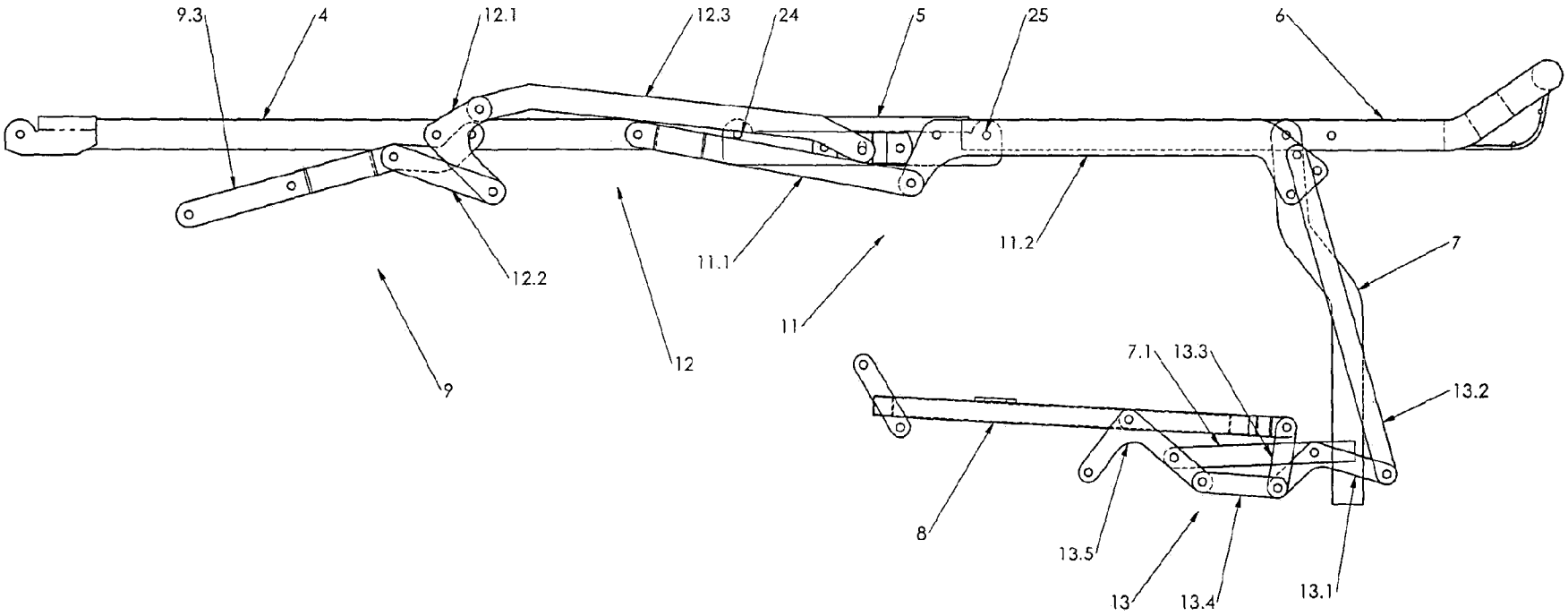

Now we can analyse the tipping mechanism 11, essentially comprising two levers: an eleventh lever 11.1 with one end hinged to an intermediate point on the second frame 4, and the other end hinged to a twelfth lever 11.2. The twelfth lever 11.2 has a second point on the same end that is connected to an intermediate point on the third frame 5. The other end of the twelfth lever 11.2 is connected to an intermediate point on the foot 7, which in turn is connected to an intermediate point on the fourth frame 6. The hinge between the third frame 5 and the fourth frame 6 also prevents the two frames from rotating beyond 180°, as shown in FIG. 21. The tipping mechanism 11 enables a rotary-translatory movement of the frames 5 and 6, from a configuration wherein the second frame 4 and the third frame 5 lie at an angle of 90°, with the fourth frame 6 virtually parallel to the second frame 4 and the foot 7 practically aligned therewith, up to a configuration wherein the three frames 4, 5 and 6 are aligned (at angles of 180° in relation to one another) and the foot is positioned at an approximately 90° angle in relation to the fourth frame 6.

The backrest tipping mechanism 13 is anchored to a portion 7.1 of the foot 7. This mechanism consists of an L-shaped thirteenth lever 13.1 with an intermediate point hinged to said portion 7.1 of the foot 7, while one end is connected by means of a fourteenth lever 13.2 to a second hole at the end of the twelfth lever 11.2. This fourteenth lever 13.2 serves as a synchronism between the tipping mechanism 11 and the backrest tipping mechanism 13. A fifteenth and a sixteenth lever 13.3 and 13.4 are hinged to the other end of the thirteenth lever 13.1. The other end of the fifteenth lever 13.3 is hinged to the tip on the backrest 8, while the other end of the sixteenth lever 13.4 is connected to a seventeenth lever 13.5 folded in an L-shape with an intermediate point hinged to an intermediate point on the backrest 8. Another point on the seventeenth lever 13.5 is hinged instead to the end of the portion 7.1 of the foot 7. This mechanism enables the backrest 8 to be folded against the fourth frame 6 when the structure is configured as a bed and, with a minimal rotation of the foot 7, it enables a considerable tilting of the backrest when the structure is converted from an armchair or sofa configuration into a recliner configuration.

Figure 22:
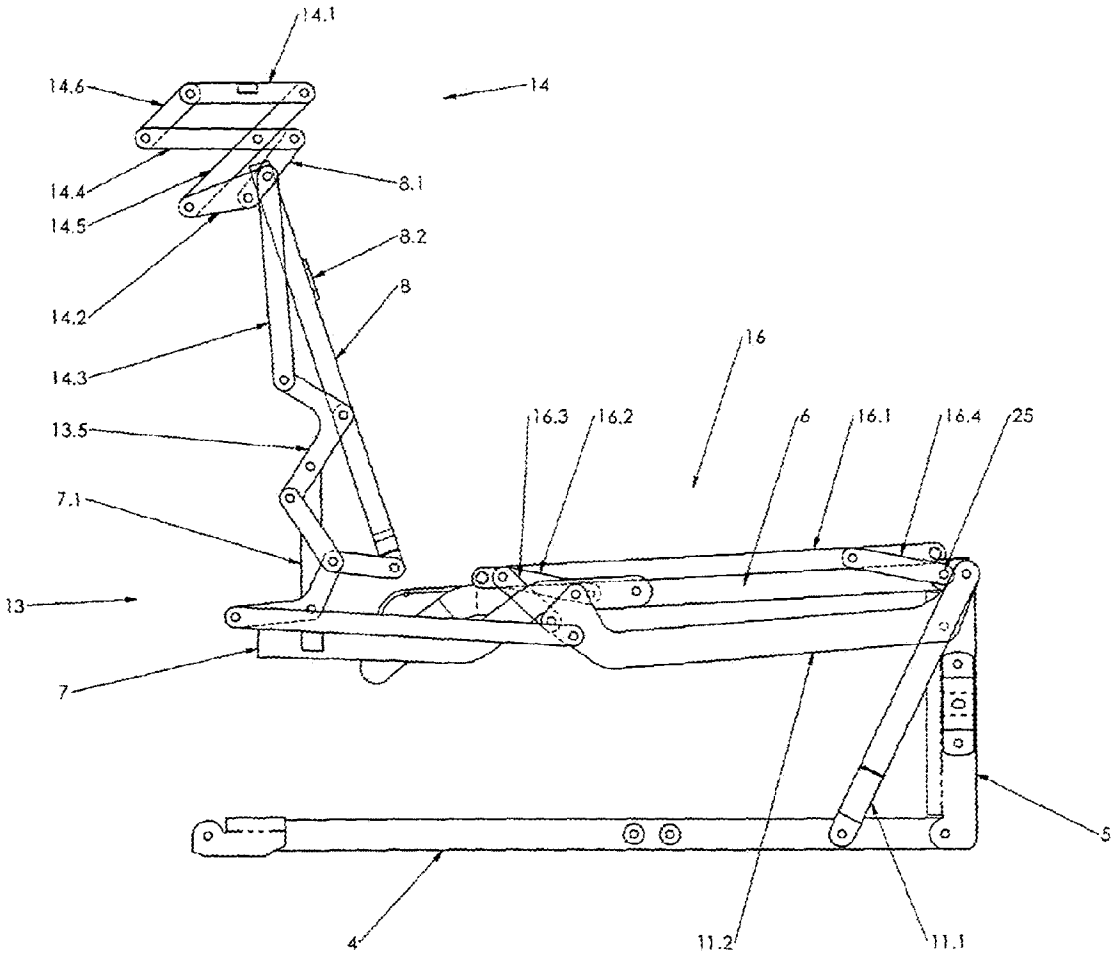

With reference to FIG. 22, we can go on to analyse the mechanism for supporting the seat 16 that comprises a fifth frame 16.1 and three levers. An eighteenth lever 16.2 is hinged to a point on the fourth frame 6, not far from the point where the foot 7 is hinged. A nineteenth lever 16.3 is hinged to a third point coinciding with the end of the twelfth lever 11.2. This lever enables the movement of the seat supporting mechanism 16 to be synchronised with the tipping mechanism 11. The other end of the two levers 16.2 and 16.3 are hinged together in line with one end of the fifth frame 16.1. The other end of the fifth frame 16.1 is connected instead by means of a twentieth lever 16.4 to the hinged connection 25 between the third and the fourth frames.

With reference again to FIG. 22, we can analyse the headrest mechanism 14. This mechanism comprises a sixth frame 14.1 operated by four levers hinged to form a pantograph. We thus have a twenty-first lever 14.2 hinged at an intermediate point thereof to the end of a plate 8.1 welded to the backrest 8. The end of the twenty-first lever 14.2 is hinged instead to twenty-second lever 14.3 that serves as a synchronism between this mechanism and the backrest tipping mechanism 13. In fact, the other end of the lever 14.3 is hinged to the seventeenth lever 13.5. A twenty-third lever 14.4 is hinged to the other end of the plate 8.1, while a twenty-fourth lever 14.5 connects the end of the twenty-first lever 14.2 to the end of the sixth frame 14.1, and a twenty-fifth lever 14.6 connects the end of the twenty-third lever 14.4 to the other end of the sixth frame 14.1. The two levers 14.4 and 14.5 are then hinged to one another at an intermediate point.

Figure 23:
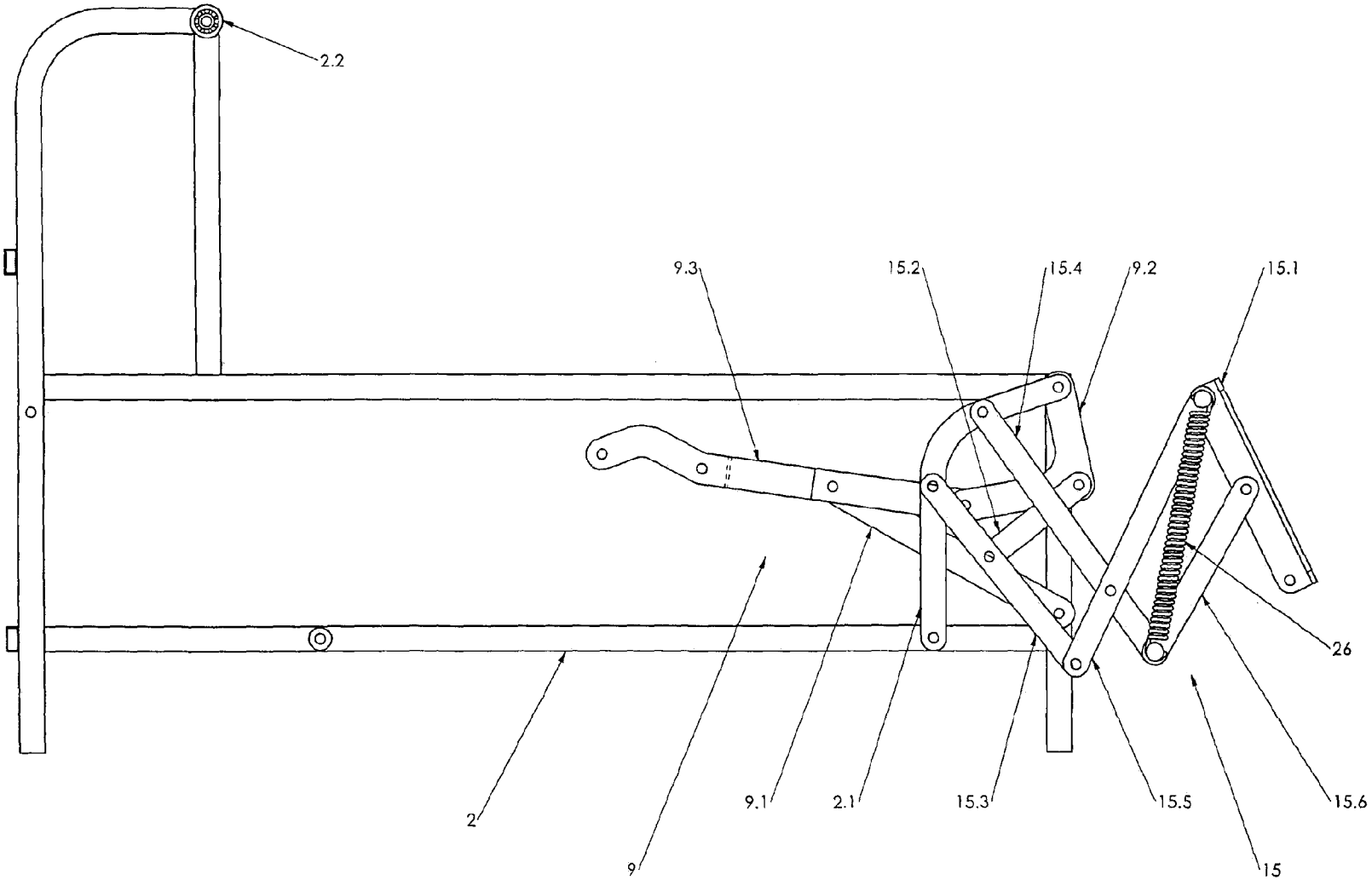

Finally, FIG. 23 shows the levers that comprise the footrest mechanism 15 together with the base mechanism 9, as seen from inside the base. The mechanism 15 consists of a bracket 15.1 to which a padded panel 22 can be anchored to serve as a footrest. The bracket 15.1 is moved by a pantograph mechanism synchronised with the base mechanism 9 by means of a twenty-sixth lever 15.2 that connects an intermediate point on the second lever 9.2 to an intermediate point on a twenty-seventh lever 15.3 of this mechanism. To avoid the mechanisms 9 and 15 interfering with one another, it is advisable to install the latter mechanism on a supporting member 2.1 of the base 2, that is advantageously connected to the point where the second lever 9.2 is hinged to the base 2 and to another point on a horizontal member of the base. The twenty-seventh lever 15.3 and a twenty-eighth lever 15.4 are hinged to this supporting member 2.1. Another two levers, a twenty-ninth lever 15.5 and a thirtieth lever 15.6, respectively, are hinged to the opposite ends of these levers. The opposite ends of these last two levers are hinged to two different points on the bracket 15.1. To enable the unequivocal rotary-translatory movement of the bracket, the two levers 15.4 and 15.5 are hinged to one another at an intermediate point.

As shown in the drawings, all the mechanisms described so far are synchronised with one another so as to enable a simple displacement, both in the conversion from the armchair or sofa configuration to that of a recliner and in the conversion from the armchair or sofa configuration to that of a bed.

We now go on to describe the movement in detail so as to better explain the functioning of the single mechanisms.

Starting from the armchair or sofa configuration, we can see that the frames 3, 4, 5 and 6 are folded and held in position at an angle of approximately 90° in relation to one another by the mechanisms 9, 10, 11 and 12. The arrangement of the four frames enable the mattress 18 to be kept folded inside the armchair. This arrangement also enables the fourth frame 6 to be exploited as a support for the seat cushion 19 of the armchair 1. This cushion can be anchored directly to the fourth frame 6, but in this case it has to be removed before converting the armchair into a bed, to avoid it interfering with the foot 7. This detail will be more obvious when we describe the conversion in question. To avoid this procedure, the seat supporting mechanism 16 can be used to anchor the seat cushions 19 to the fifth frame 16.1, which will enable the cushions to be displaced automatically, during the conversion, in relation to the fourth frame 6 and consequently not to interfere with the foot 7. In the configuration as an armchair, the fifth frame 16.1 is in direct contact with the fourth frame 6 so the seat cushions 19 are positioned properly.

When configured as an armchair or sofa, the backrest 8 can rotate backwards thanks to the backrest tipping mechanism 13. This movement is prevented, however, by the limit stop between a tab 8.2 on the backrest 8 and a low-friction supporting element 2.2 on the base 2. In the figures, this supporting element is in the form of a small bearing, but it can also consist of any other technically equivalent element. The backrest cushion 20 can be firmly attached to the backrest 8.

The headrest mechanism 14, if any, is suitably folded against the backrest and carries the headrest cushion 21, anchored to the sixth frame 14.1.

The footrest mechanism 15, again if any, positions the padded footrest panel 22 vertically, firmly attached to the bracket 15.1.

From this configuration, users seated in the armchair or on the sofa can press with their backs against the backrest (force Fl in FIGS. 7 and 8), while exerting an opposite force on the seat (force F2 in FIGS. 7 and 8) at the same time. This pressure encounters the opposition of the limit stop between the tab 8.2 and the bearing 2.2 so the only feasible movement for the mechanism is a forward displacement. With reference to FIGS. 7, 8, 9, 17 and 18, we can see that the mechanism 10 enables a rotary-translatory displacement of the first frame 3, leaving the distance of the hinge 23 from the floor virtually unchanged. The second frame 4, and consequently also frames 5 and 6, guided by the first frame 3 and the base mechanism 9, move forward and tilt slightly so as to make the reclining position more comfortable. The backrest meanwhile remains up against the bearing 2.2 on the base and consequently rotates in relation to the fourth frame 6, giving rise to a reclining position. The rotation of the backrest is such that the user is never without suitable support for the lumbar spine, as we can see from FIG. 18. The headrest mechanism 14 and the footrest mechanism simultaneously bring the headrest cushion 21 and the footrest 22 into a suitable position for supporting the user's head and legs.

The armchair does not need to be moved away from the real wall in order to be converted into a recliner position because it is not the backrest that extends outwards when it is tilted, but the seat that moves forwards.

Figure 1:
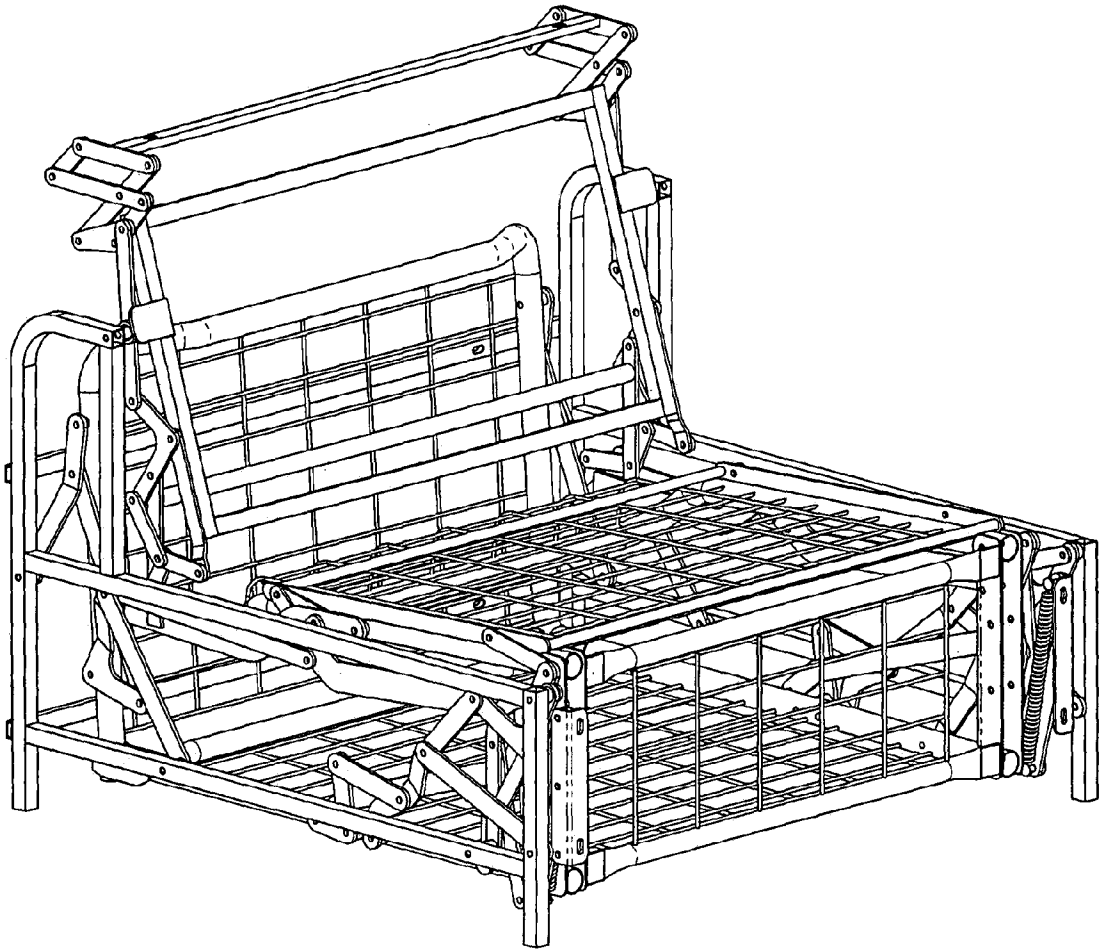
FIG. 1 shows a perspective view of the structural framework according to the invention configured as an armchair.
Figure 2:
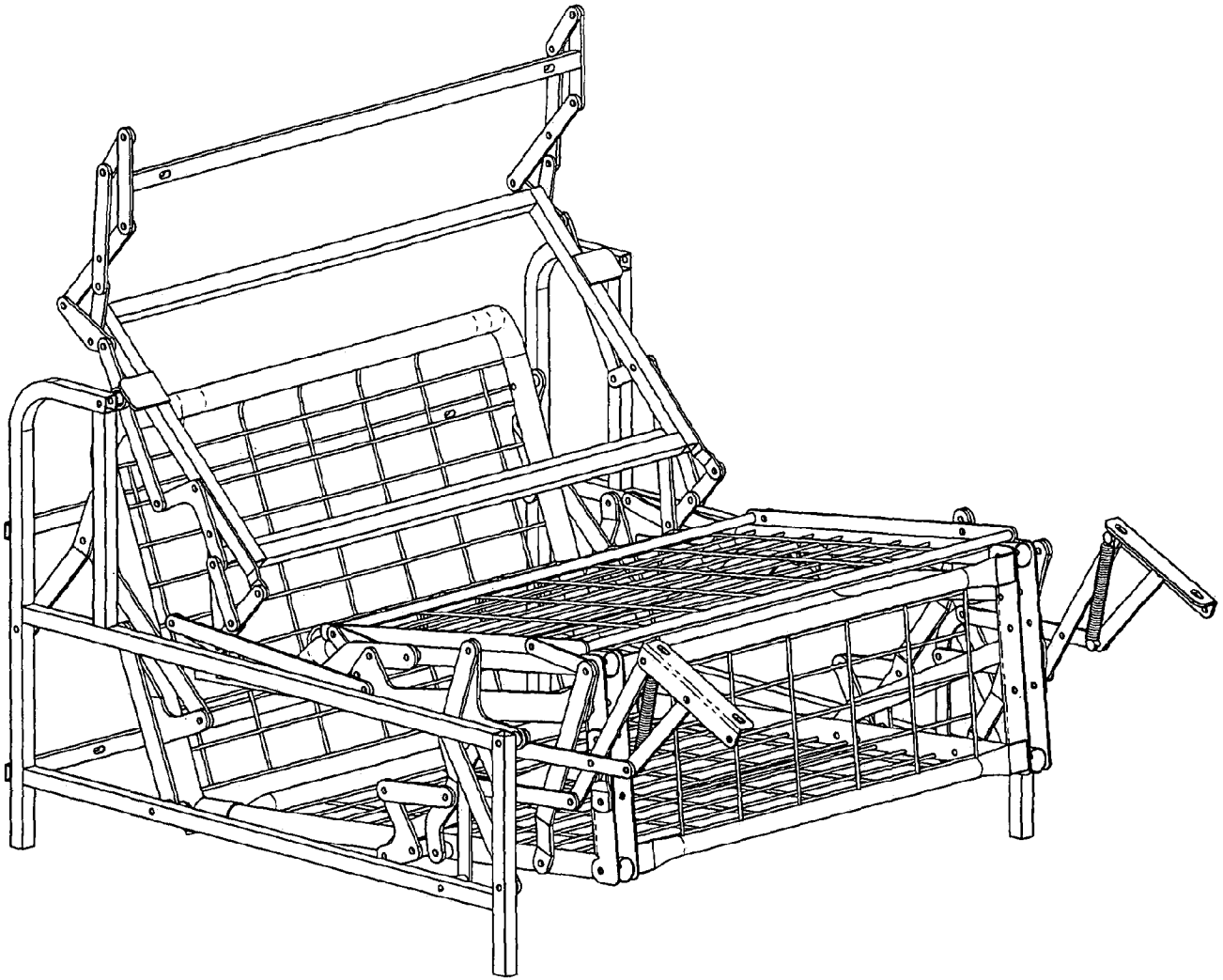
FIG. 2 shows a perspective view of the structural framework according to the invention configured as a recliner.
Figure 3:
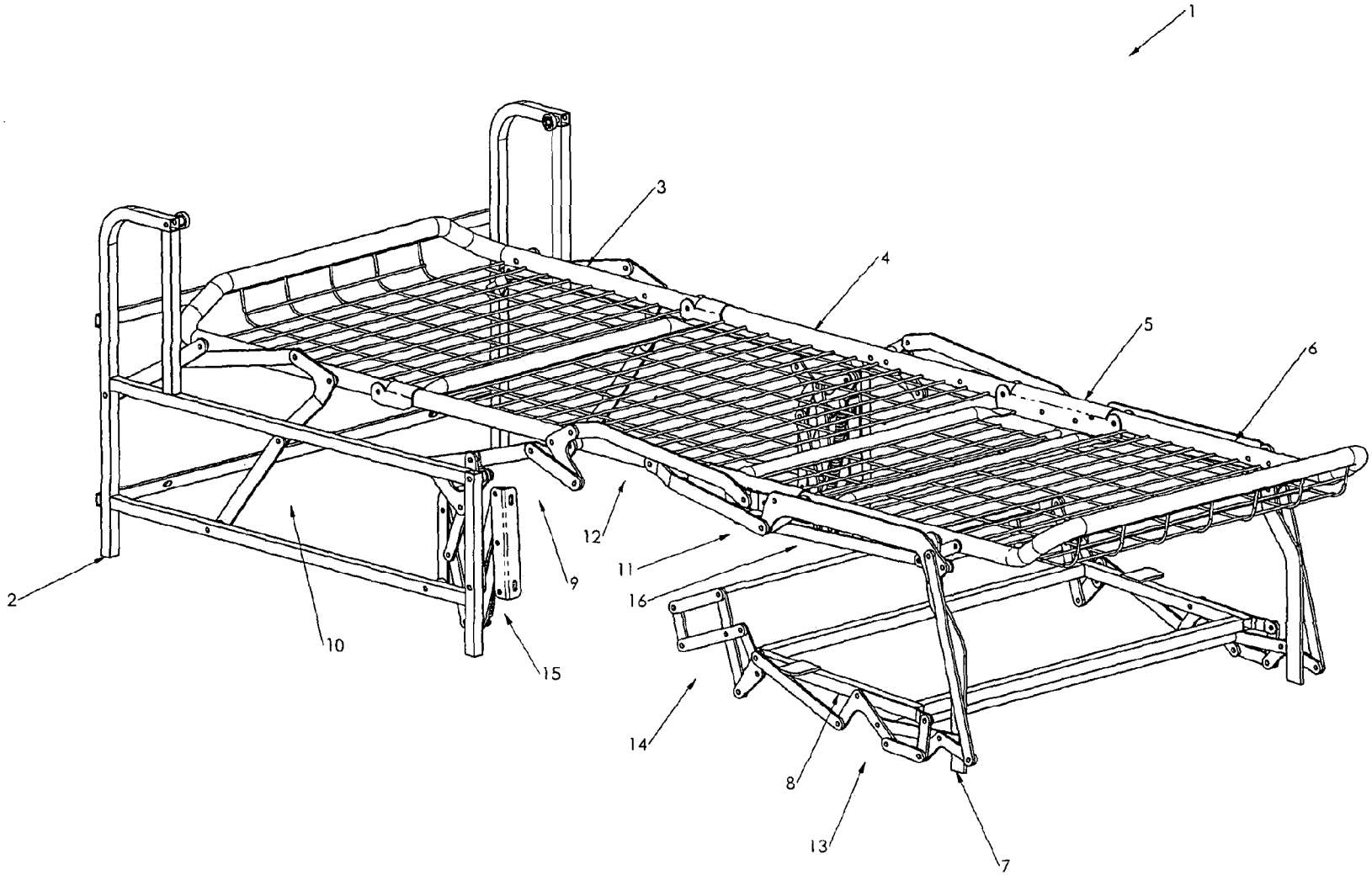
FIG. 3 shows a perspective view of the structural framework according to the invention configured as a bed.
Figure 4:
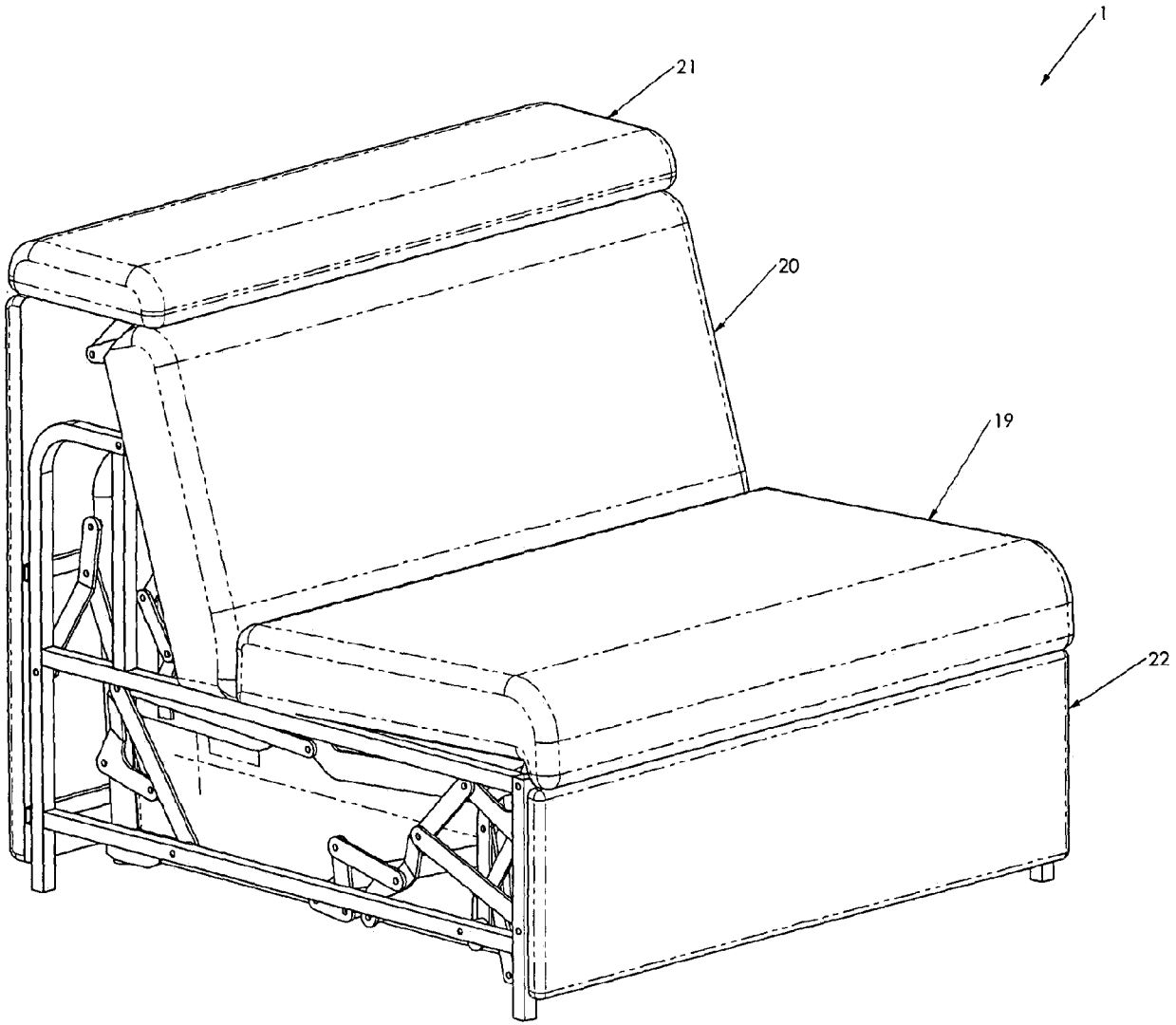
FIG. 4 shows a perspective view of the structural framework according to the invention configured as an armchair complete with cushions and a mattress.
Figure 5:
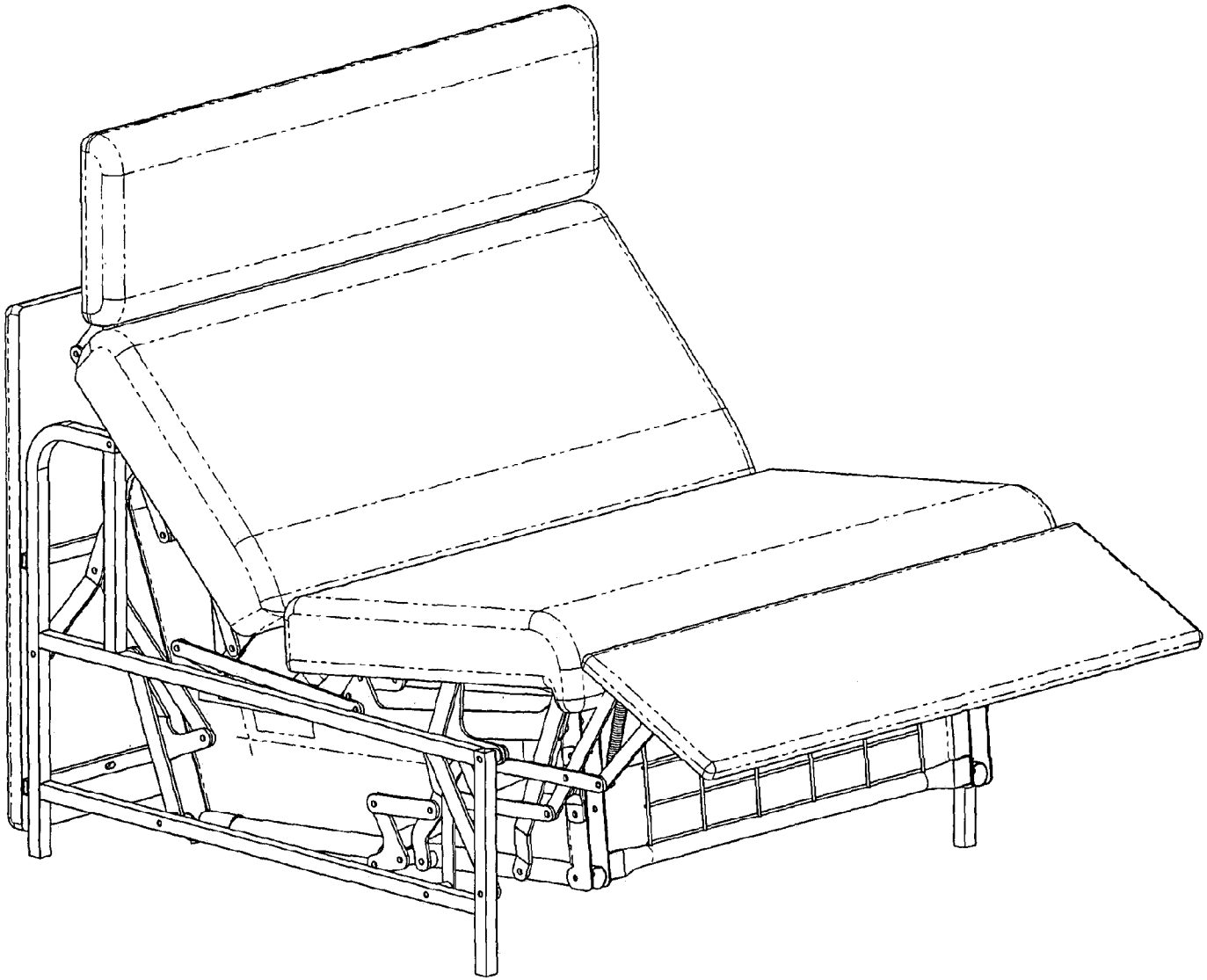
FIG. 5 shows a perspective view of the structural framework according to the invention configured as a recliner complete with cushions and a mattress.
Figure 6:
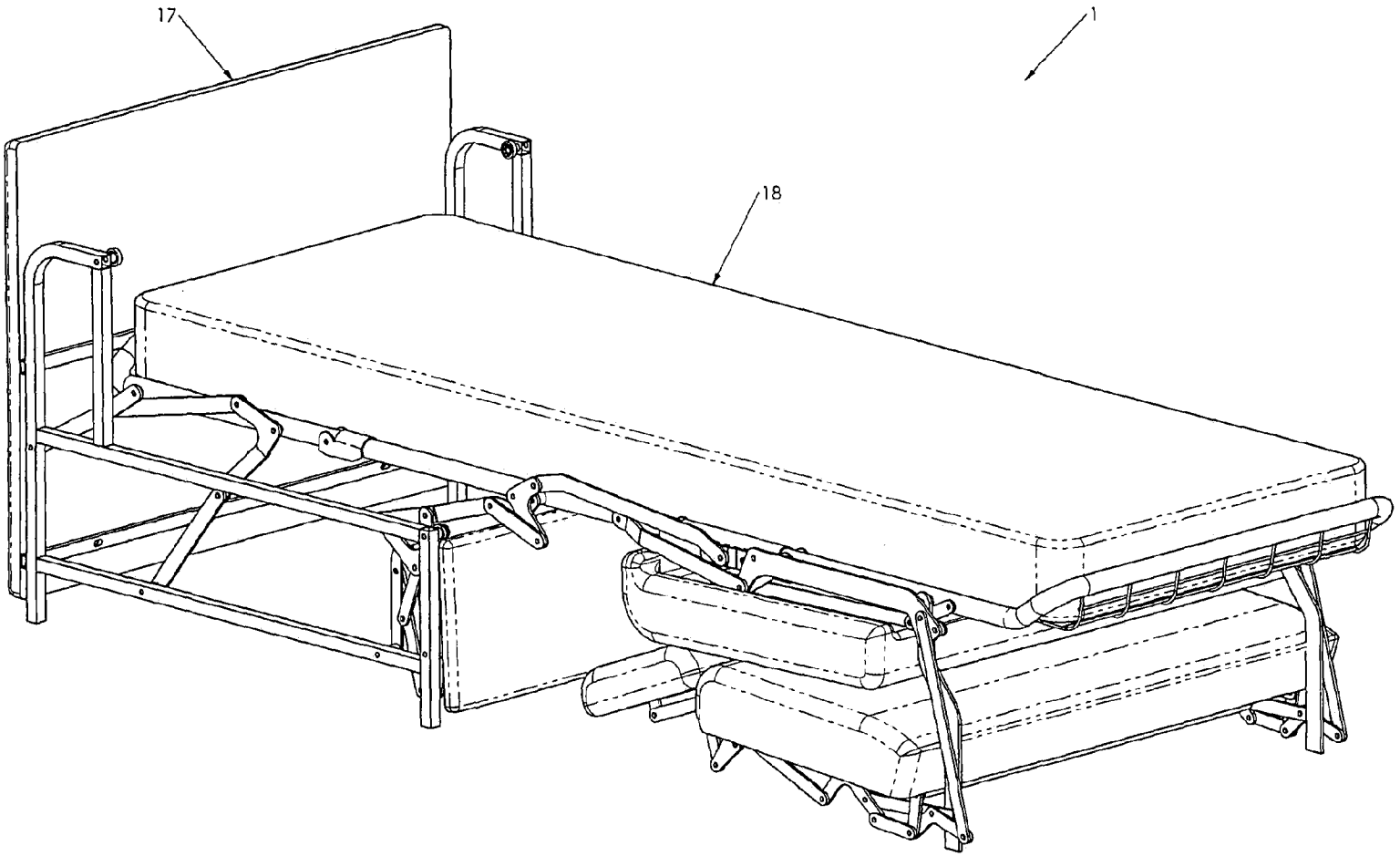
FIG. 6 shows a perspective view of the structural framework according to the invention configured as a bed complete with cushions and a mattress.
Figure 9:
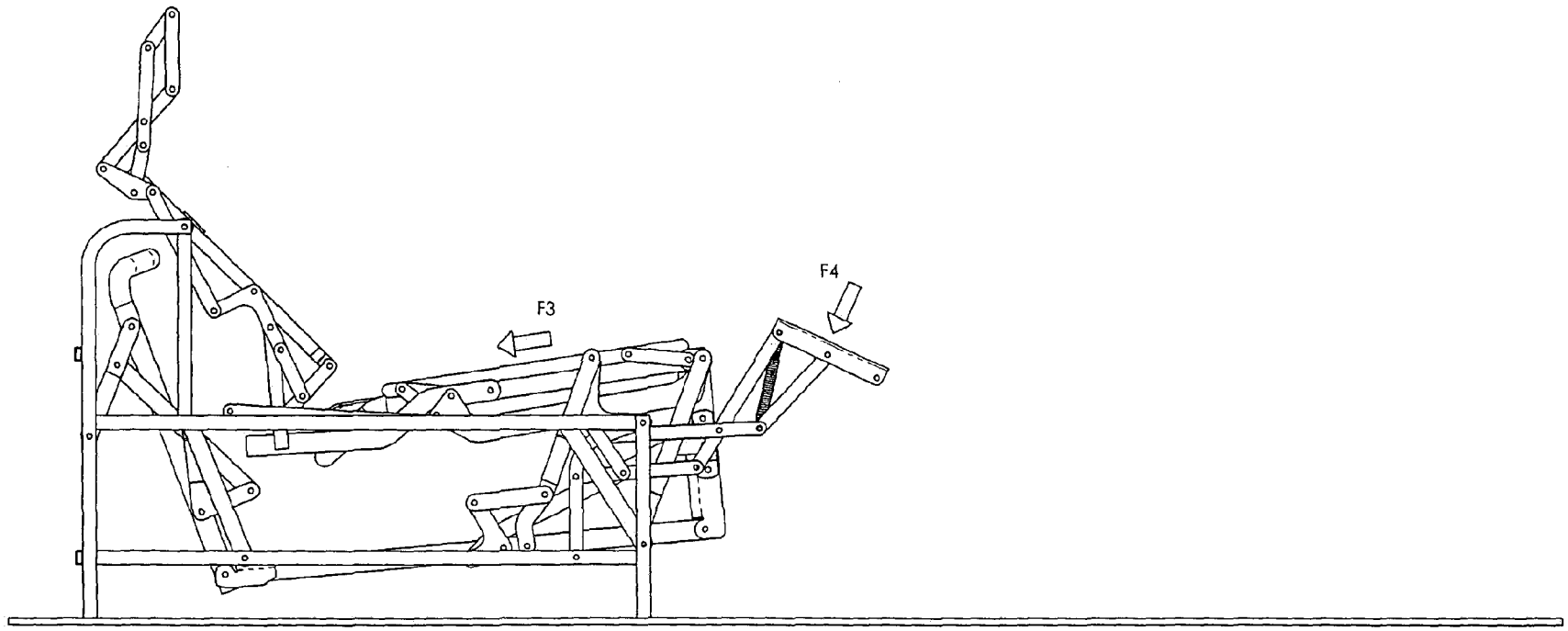
FIG. 9 shows a side view of the structural framework according to the invention configured as a recliner.

Users can stop in whatever position they find most comfortable, or reach the limit position illustrated in FIGS. 5, 9 and 18. This position is limited by the length of the slot.

To make the reclining position and the intermediate positions stable, there is an elastic element 26, i.e. a draw spring, between two hinged connections of the footrest mechanism 15. This elastic element is calibrated so that, in association with the unavoidable friction in the hinged connections, it is able to balance the weight of the mechanics and the user, practically making every position reached by the user stable by means of its action. As shown in FIG. 24, the elastic element 26 is advantageously unable to take effect when in the armchair or sofa configuration because three hinged connections come to be virtually aligned, i.e. those of the twenty-sixth lever 15.2 with that of the second lever 9.2 and of the base. The armchair or sofa configuration is consequently always stable, even when nobody is sitting therein or thereon, because the force of the elastic spring 26 tends to open the footrest and consequently to move the second lever 9.2 with the aid of the twenty-sixth lever 15.2, but it fails to do so because of the above-mentioned alignment. In point of fact, as shown in FIG. 24, the three hinges are not perfectly aligned, but have slightly exceeded their dead centre. As a result, the action of the elastic element would tend, at most, to make the second lever 9.2 rotate in the opposite direction to the one needed to move the armchair into the reclining position (a rotation that is prevented in any case by the rest of the mechanism). When the user deliberately exerts a pressure on the backrest so as to make the seat cushions move forward, the second lever begins to rotate in the right direction, interrupting the alignment of the hinged connections, and enabling the elastic element 26 to take effect, by means of the twenty-sixth lever 15.2, on the base mechanism 9, to move towards the reclining configuration. To return to the armchair or sofa configuration, users have to take their weight off the backrest and make the seat move backwards (force F3 in FIG. 9). Users can facilitate this step by pushing with their legs against the footrest (force F4 in FIG. 9), so as to overcome the force of the elastic element 26. Of course, as mentioned previously, the elastic element 26 positioned as described is not the only possible solution. An elastic element can be used that takes effect constantly (with no dead centres), providing a release mechanism that makes the armchair or sofa configuration stable is added. A gas spring can also be used, again combined with a release mechanism, or a gas spring with a control, or a gas spring that only takes effect when a cord is pulled, so that once users have reached the required position, they can release the control and thereby block the spring. Last but not least, an electromechanical actuator may be used to implement the movement simply be pressing a button.

Figure 10:
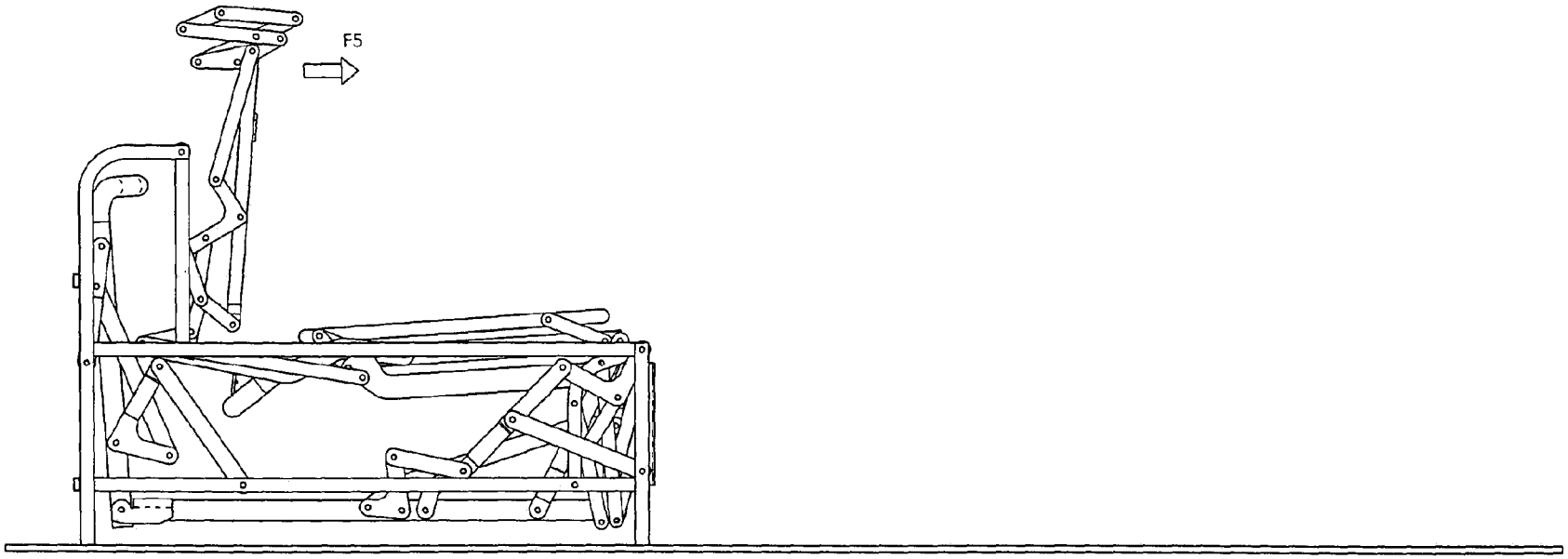
Figure 11:
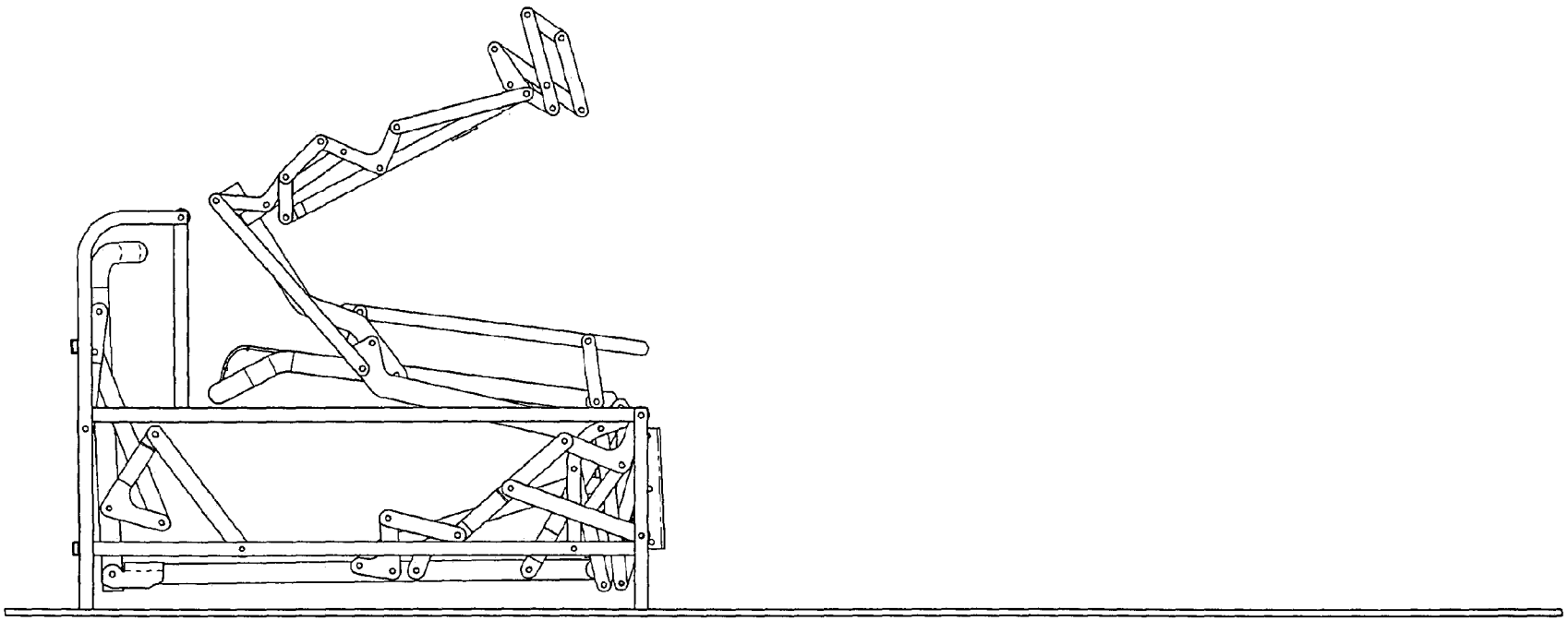
Figure 12:
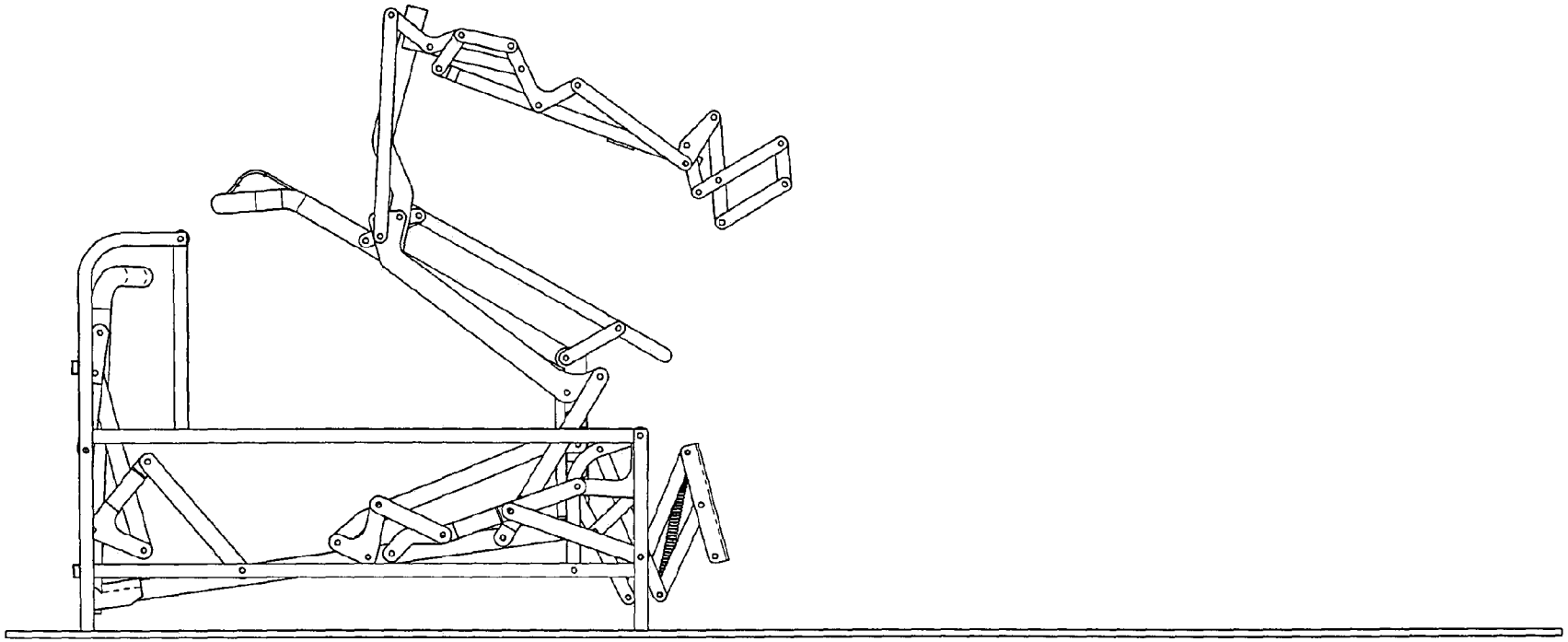
Figure 13:
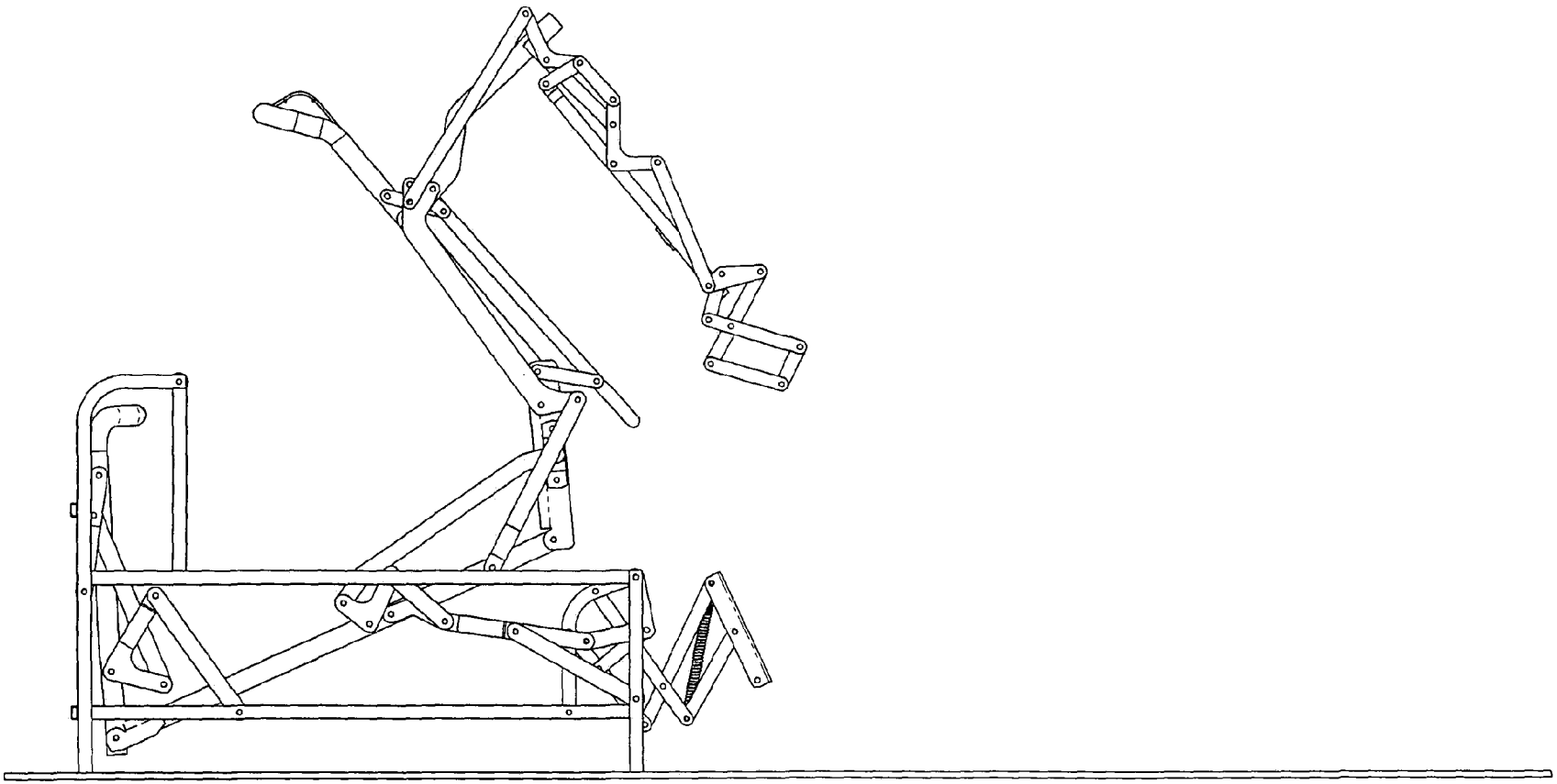

Going on now to the conversion of the armchair into a bed, the user simply needs to pull on the armchair's backrest (force F5 in FIG. 10), and then accompany the movement. Users thus enable the backrest tipping mechanism 13 that, by means of the fourteenth lever 13.2, triggers the tipping mechanism 11, which in turn makes the third and fourth frames 5 and 6 rotate in relation to the second frame 4. The rotation of the third frame enables the rotation of the base mechanism 9 by means of the synchronising mechanism 12, but in the opposite direction this time to that of the rotation to obtain the recliner configuration. The base mechanism 9 and the supporting mechanism 10 move the first and the second frames 3 and 4 until the four frames are fully aligned. This gives rise to a stable and comfortable bed complete with a mattress. In a fully synchronised movement, the seat supporting mechanism 16 makes the seat cushion 19 move so as to avoid it interfering with the foot 7. At the end of the procedure, the seat cushion 19 and the backrest cushion 20 come to be one against the other underneath the bed, while the foot 7 supports the end of the bed.

The bed is very stable. In fact, even if the user were to load the area of the bed coinciding with the hinge 23 (force F6 in FIG. 20), the bed could not fold because the line that joins the hinged connections of the tenth lever 12.3 advantageously exceeds the alignment with the hinge 24. This means that, when the hinge 23 is loaded, the base mechanism 9 would tend to make the third frame 5 rotate beyond 180° in relation to the second frame 4, which is impossible, as explained previously. Moreover, for this to be possible, the foot would have to pass through the floor.

Figure 14:
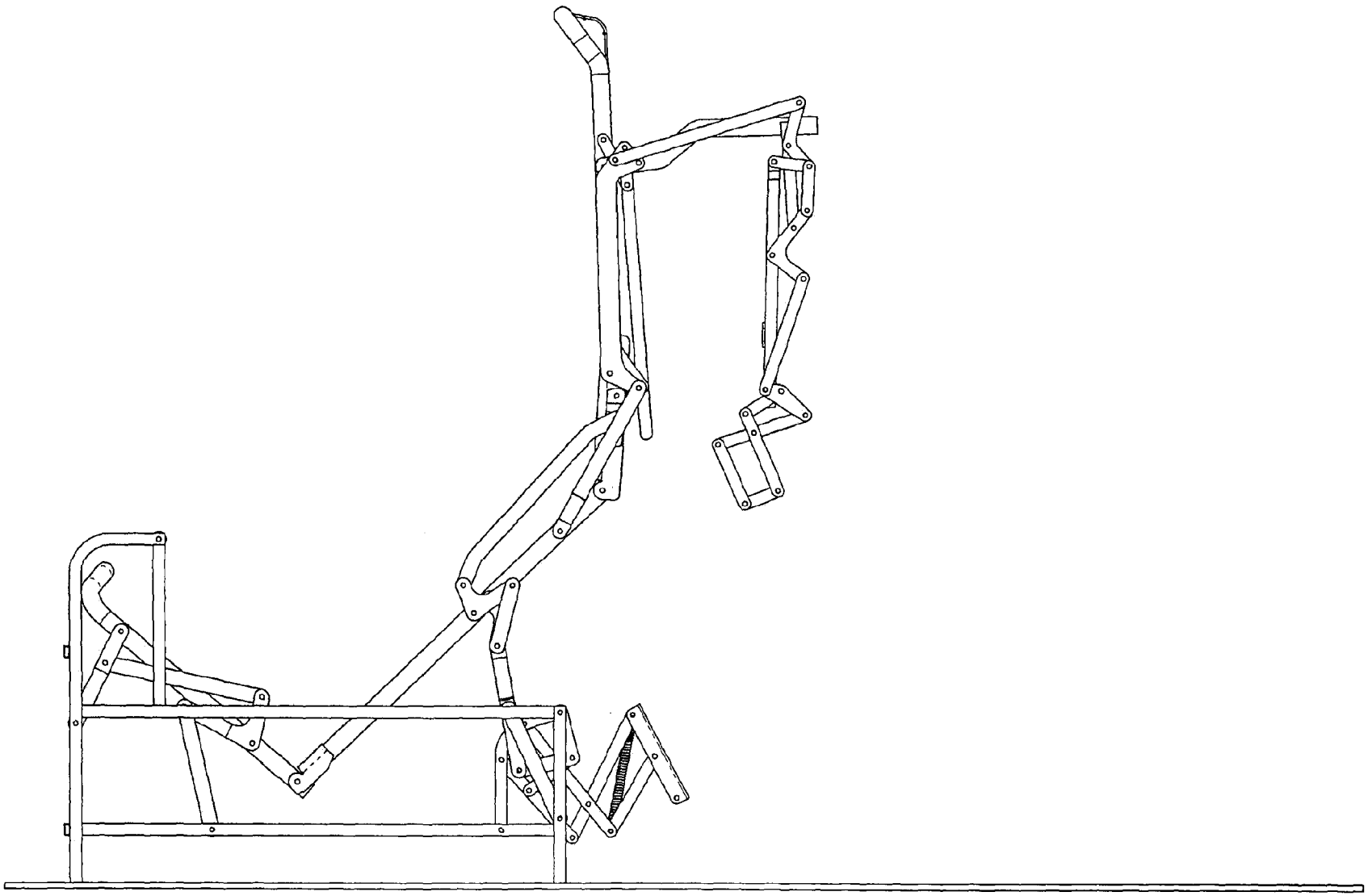
Figure 15:
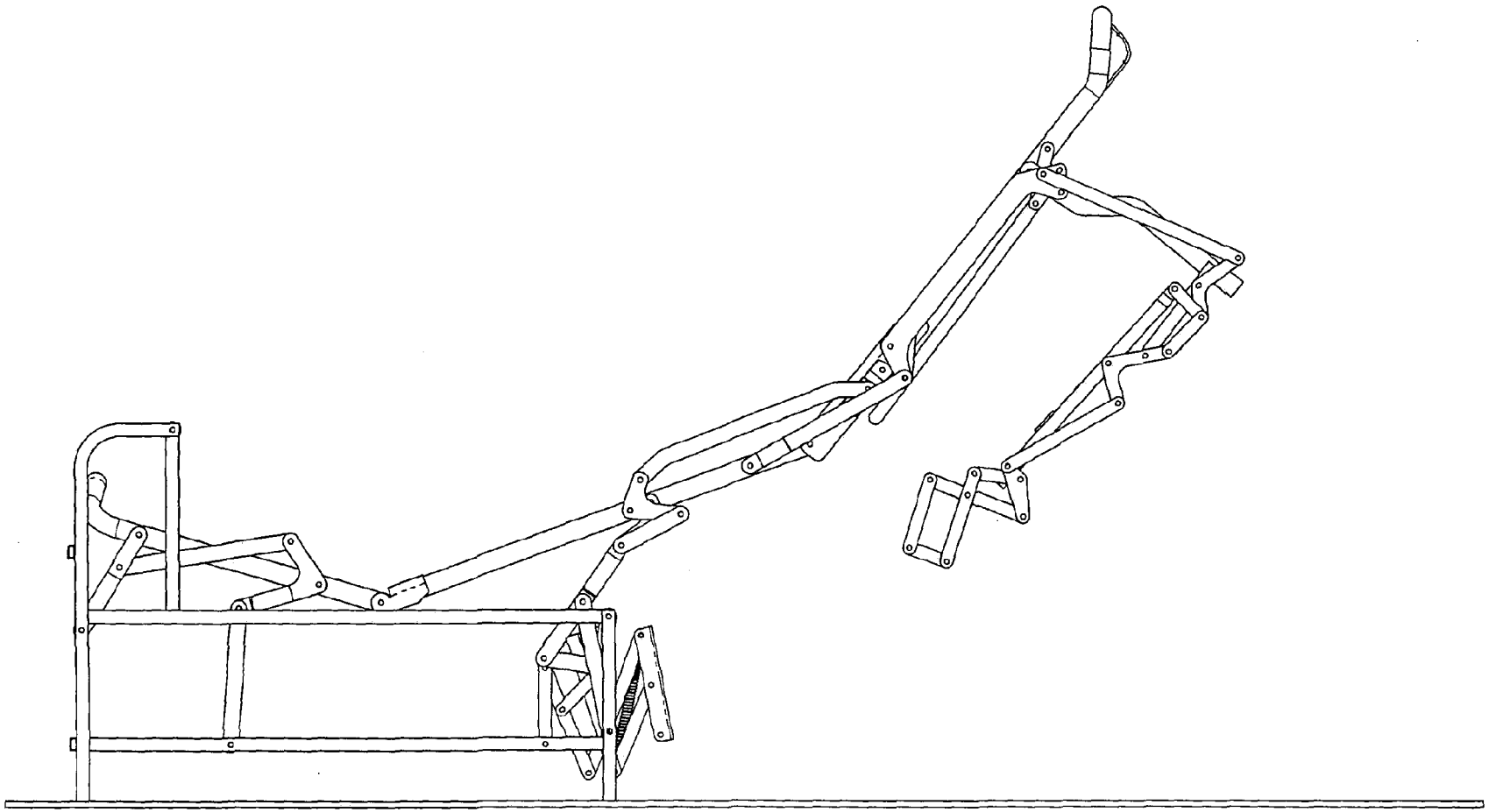

During the movement for converting the armchair into a bed, the headrest automatically comes to occupy less space and does not touch the floor. The footrest also moves because it is synchronised with the movement of the base mechanism 9. Its movement has no negative influence on the opening procedure, however. Quite the reverse: because the elastic element 26 has been positioned on the footrest supporting mechanism 15, this element is able to reduce the force needed to convert the armchair into a bed. In fact, the elastic element is loaded when in the armchair configuration and released during the conversion process, facilitating the user in the raising of the frames. Once the mechanism has reached the position shown in FIG. 14 (of substantial equilibrium), users no longer need to pull, but merely to support the end of the bed. This load is also made lighter by the elastic element 26, which begins to be loaded again during this phase because the footrest supporting mechanism 15 begins to fold again, as shown in the subsequent figures.

The procedure for converting the bed back into an armchair or sofa is practically the same in reverse order. Users simply have to raise the end of the bed (force F6 in FIG. 16) to enable the inverse rotation of all the mechanisms until the original position is restored. The elastic element will therefore first be released, helping the user to raise the end of the bed, and then, when it reaches the position shown in FIG. 14, it will start being loaded again, helping the user to prevent the frames from dropping into the base.

Here again, for this conversion process, other types of elastic element, and in other arrangements, or electromechanical actuators, may be used instead.

The elastic element substantially facilitates all the stages of displacement of the mechanism and particularly makes the recliner and the armchair and sofa configurations stable. The same purpose can be achieved by using other kinds of elastic element, however (e.g. compression springs, torsion bars, gas springs, controlled gas springs, and the like) and positioned at other points of the mechanics. In other words, the mechanism's dynamic configuration as illustrated is purely an example. Given the nature of the structural framework 1, that essentially has only one degree of freedom (if we exclude the positioning tolerance introduced by the slot), it is also easy to obtain a fully automated movement with the aid of electromechanical actuators.

The above-described structural framework for a convertible armchair or sofa may undergo numerous modifications and variants, all coming within the scope of the inventive concept; and all the details may be substituted by others that are technically equivalent. Finally, any materials and dimensions may be used, according to need and the state of the art.

The invention claimed is:

1. A structural framework for a convertible armchair or sofa, said framework comprising a box-shaped base supporting a plurality of frames hinged to one another, said plurality of frames including a seat frame suitable, alone, for directly or indirectly supporting a seat cushion on one of its sides and, in combination with the other frames of said plurality of frames, for supporting a mattress on its other side, mechanisms for the displacement of said frames, and of a backrest and a foot, in relation to one another and with respect to said base, between a stable configuration as a sofa or armchair, wherein said frames remain inside said base and form a cavity for containing said folded mattress and a stable configuration as a bed wherein said frames extend forward, becoming aligned to define a horizontal resting surface that extends beyond said base and is supported by said foot, and said backrest comes to occupy a position underneath said bed, further comprising a stable reclining configuration wherein, by comparison with said configuration as an armchair or sofa, said backrest is tilted further backwards and said seat frame is arranged in a position of at least one of the following:

extending further forwards; and tilting upwards, and in said armchair or sofa configuration, the backward rotation of said backrest is prevented by a tab on said back rest abutting against a low-friction bearing provided on said base, whereby the backrest remains up against the bearing on the base and consequently rotates in relation to said seat frame, wherein said plurality of frames comprises a first frame, a second frame, a third frame and said seat frame, and said mechanisms comprise a base mechanism for the displacement of said second frame, a supporting mechanism for the displacement of said first frame, and a tipping mechanism for the displacement of said third frame and said seat frame in relation to said second frame and for opening said foot, a synchronizing mechanism for synchronizing the movements of said base mechanism and said tipping mechanism, and a backrest tipping mechanism for tipping said backrest in relation to said foot, and wherein said base mechanism comprises first and second levers hinged at one end to a vertical member of said base, and at the other end to a third lever hinged in turn to an intermediate point on said second frame.

2. The structural framework for a convertible armchair or sofa according to claim 1, wherein said supporting mechanism comprises a fourth lever hinged at one end to a horizontal member of said base and at the other end to a fifth lever folded into an L-shape and also hinged at an intermediate point to said first frame, a sixth lever hinged at one end to said base and at the other end to said first frame, and a seventh lever connecting an intermediate point on said sixth lever with the other end of said fifth lever.

3. The structural framework for a convertible armchair or sofa according to claim 2, wherein said synchronising mechanism comprises an eighth lever folded into an L-shape and hinged at an intermediate point to said second frame, and at one end to a ninth lever, the opposite end of which is connected to an intermediate point on said third lever, and a tenth lever with one end hinged to said eighth lever and the other end engaging in a slot on said third frame.

4. The structural framework for a convertible armchair or sofa according to claim 3, wherein said tipping mechanism comprises an eleventh lever with one end hinged to an intermediate point on said second frame and the other end hinged to a first end of a twelfth lever, said twelfth lever having a second point of said first end thereof that is connected to an intermediate point on said third frame and a second end of said twelfth lever being connected to an intermediate point on said foot, which is in turn connected to an intermediate point on said seat frame.

5. The structural framework for a convertible armchair or sofa according to claim 4, wherein said backrest tipping mechanism is anchored to a portion of said foot and comprises an L-shaped thirteenth lever with an intermediate point hinged to said portion of said foot, one end of said thirteenth lever being connected by means of a fourteenth lever to a hole at the second end of said twelfth lever, and the other end of said thirteenth lever being hinged to one end of fifteenth and sixteenth levers, the other end of said fifteenth lever being hinged to said backrest, and the other end of said sixteenth lever being connected to a seventeenth lever folded into an L-shape and with an intermediate point hinged to an intermediate point at said backrest and another point hinged to an end of said portion of said foot.

6. The structural framework for a convertible armchair or sofa according to claim 5, further comprising a further seat supporting mechanism consisting of a seat supporting frame, an eighteenth lever hinged at one point on said seat frame, a nineteenth lever hinged to a third point coinciding with the second end of said twelfth lever, the other end of said eighteenth and nineteenth levers being hinged together in line with one end of said seat supporting frame, the other end of which is connected by means of a twentieth lever to a hinged connection between said third frame and said seat frame.

7. The structural framework for a convertible armchair or sofa according to claim 5, further comprising a headrest mechanism consisting of a headrest frame operated by a pantograph system comprising a twenty-first lever hinged at an intermediate point thereof to one end of a plate welded to said backrest and with one end hinged to a twenty-second lever, one end of which is in turn hinged to said seventeenth lever, a twenty-third lever being hinged to the other end of said plate, a twenty-fourth lever connecting one end of said twenty-first lever to one end of said sixth frame, and a twenty-fifth lever connecting one end of said twenty-third lever to the other end of said sixth frame, said twenty-third and twenty-fourth levers being hinged to one another at an intermediate point.

8. The structural framework for a convertible armchair or sofa according to claim 7, further comprising a footrest mechanism consisting of a bracket driven by a pantograph system synchronised with said base mechanism by means of a twenty-sixth lever that connects an intermediate point on said second lever to an intermediate point on a twenty-seventh lever.

9. The structural framework for a convertible armchair or sofa according to claim 8, further comprising an elastic element designed to make at least said reclining configuration stable.

10. The structural framework for a convertible armchair or sofa according to claim 9, wherein said elastic element connects two points on said footrest mechanism.

* * * * *